US010181283B2

(12) United States Patent
Wang et al.

(10) Patent No.: US 10,181,283 B2
(45) Date of Patent: Jan. 15, 2019

(54) ELECTRONIC CIRCUIT AND DRIVING METHOD, DISPLAY PANEL, AND DISPLAY APPARATUS

(71) Applicant: BOE TECHNOLOGY GROUP CO., LTD., Beijing (CN)

(72) Inventors: Zhiliang Wang, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/571,421

(22) PCT Filed: Jun. 12, 2017

(86) PCT No.: PCT/CN2017/087883
§ 371 (c)(1),
(2) Date: Nov. 2, 2017

(87) PCT Pub. No.: WO2018/010511
PCT Pub. Date: Jan. 18, 2018

(65) Prior Publication Data

US 2018/0226020 A1 Aug. 9, 2018

(30) Foreign Application Priority Data

Jul. 11, 2016 (CN) ..... 2016 1 0543844

(51) Int. Cl.
*G09G 3/3225* (2016.01)
*G09G 3/3266* (2016.01)
*G09G 3/3275* (2016.01)

(52) U.S. Cl.
CPC ..... *G09G 3/3225* (2013.01); *G09G 3/3266* (2013.01); *G09G 3/3275* (2013.01);
(Continued)

(58) Field of Classification Search
CPC .. G09G 3/3225; G09G 3/3266; G09G 3/3275; G09G 2300/0819;
(Continued)

(56) References Cited

U.S. PATENT DOCUMENTS 9,691,328 B2 6/2017 Qing et al.
2010/0109717 A1 5/2010 Lin
(Continued)

FOREIGN PATENT DOCUMENTS

CN 103700346 A 4/2014

OTHER PUBLICATIONS

International Search Report and Written Opinion in PCT/CN2017/087883 dated Sep. 5, 2017.

*Primary Examiner* — Afroza Chowdhury
(74) *Attorney, Agent, or Firm* — SYNCODA LLC; Feng Ma; Junjie Feng

(57) ABSTRACT

An electronic circuit for driving an electronic component is disclosed. The electronic circuit includes a drive subcircuit, a first subcircuit, a second subcircuit, a third subcircuit, a fourth subcircuit, and a fifth subcircuit. Under control of a data signal terminal, a scan signal terminal, a first control signal terminal, a second control signal terminal, a first power supply terminal, and a second power supply terminal, the drive subcircuit is configured to have a diode connection or a source-follow connection so as to maintain a substantially stable working current running through the electronic component. The electronic circuit can be a pixel circuit, and the electronic component can be a light-emitting component comprising an organic light-emitting diode (OLED). A display panel and a display apparatus containing the electronic circuit, as well as a method for driving the electronic circuit are also disclosed.

18 Claims, 11 Drawing Sheets

(52) U.S. Cl.
CPC ..... *G09G 2300/0819* (2013.01); *G09G 2310/0262* (2013.01); *G09G 2320/0233* (2013.01); *G09G 2320/045* (2013.01)

(58) Field of Classification Search
CPC ... G09G 2310/0262; G09G 2320/0233; G09G 2320/045
See application file for complete search history.

(56) References Cited

U.S. PATENT DOCUMENTS

| | | | | |
|---|---|---|---|---|
| 2012/0001893 | A1* | 1/2012 | Jeong ..... | G09G 3/3233 345/213 |
| 2014/0022150 | A1 | 1/2014 | Guo et al. | |
| 2015/0371590 | A1* | 12/2015 | Jeong ..... | G09G 3/3291 345/213 |
| 2016/0196783 | A1 | 7/2016 | Hu et al. | |
| 2017/0116918 | A1 | 4/2017 | Dong et al. | |

* cited by examiner

ELECTRONIC CIRCUIT AND DRIVING METHOD, DISPLAY PANEL, AND DISPLAY APPARATUS

CROSS-REFERENCES TO RELATED APPLICATION

The present application claims priority to Chinese Patent Application No. 201610543844.X filed on Jul. 11, 2016, the disclosure of which is hereby incorporated by reference in its entirety.

TECHNICAL FIELD

The present disclosure relates generally to the field of display technologies, and more specifically to an electronic circuit and its driving method, a display panel, and a display apparatus.

BACKGROUND

Organic light-emitting diode (OLED) is a hot area in the current development of flat panel display devices. Compared with liquid crystal display (LCD) devices, OLED display devices typically have advantages such as low power consumption, low manufacturing cost, self-luminescence, wide viewing angle, and fast response speed. At present time, OLED display devices are starting to replace traditional LCD display devices, such as in cell phones, tablet computers, digital cameras, large-screen TVs, etc.

Unlike an LCD, which employs a stable voltage to control its brightness, an OLED is driven by an electric current, and a stable current is needed for the control of light emission. For reasons related to manufacturing processes and component aging, the threshold voltage (Vth) of driver transistors of the pixel circuit is not constant, causing changes in the current flowing through each OLED, which in turn results in non-uniform brightness of display, negatively influencing the whole image display effect.

In addition, the current flowing through each OLED is related to the voltage of the source electrode of the associated driver transistor, i.e., the voltage of the power supply. A voltage drop across the circuits resulting from the product of the electrical current (I) and the resistance (R), referred to as the IR Drop, can also result in differences in currents in different areas of the screen, in turn causing non-uniform brightness in OLEDs in different areas.

SUMMARY

In order to address the issues associated with current OLED display technologies, the present disclosure provides an electronic circuit and a driving method thereof, a display panel, and a display apparatus.

In a first aspect, an electronic circuit is disclosed, which is configured to maintain a substantially stable working current running through an electronic component.

The electronic circuit includes a drive subcircuit, a first subcircuit, a second subcircuit, a third subcircuit, a fourth subcircuit, and a fifth subcircuit.

The drive subcircuit includes a first terminal, a second terminal, and a third terminal. The first terminal is coupled to a second node. A current from a first terminal to a second terminal is controlled by a signal from a third terminal. The drive subcircuit is configured to drive the electronic component via the second terminal.

The first subcircuit is coupled to a data signal terminal, a scan signal terminal and a first node, and the first subcircuit is configured to provide a signal from the data signal terminal to the first node under control of the scan signal terminal.

The second subcircuit is coupled to a first power supply terminal, a first control signal terminal and a second node, and the second subcircuit is configured to provide a signal from the first power supply terminal to the second node under control of the first control signal terminal.

The third subcircuit is coupled to the scan signal terminal and a second power supply terminal, and is further coupled to the second terminal and the third terminal of the drive subcircuit. The third subcircuit is configured to control the drive subcircuit to have a diode connection or a source-follow connection via the scan signal terminal and the second power supply terminal.

The fourth subcircuit is coupled to the first node and the second node, and the fourth subcircuit is configured to charge or discharge under control of a signal from the first node and a signal from the second node, and is further configured to maintain a stable voltage difference between the first node and the second node if the first node is in a floating state.

The fifth subcircuit is coupled to a second control signal terminal, the first node, the second terminal, and the third terminal, of the drive subcircuit, and a first terminal of the electronic component. The fifth subcircuit is configured to electrically couple the first node with the third terminal of the drive subcircuit, and to electrically couple the second terminal of the drive subcircuit with the electronic component under control of the second control signal terminal, so as to control the drive subcircuit to drive the electronic component.

Herein the drive subcircuit can be a driver transistor, and the electronic circuit can be a pixel circuit employed in light-emitting component such as an organic light-emitting diode (OLED), and can also be a circuit employed in other types of electronic components.

According to some embodiments of the electronic circuit, the drive subcircuit includes a driver transistor. As such the first terminal, the second terminal, and the third terminal of the electronic circuit are respectively a source electrode, a drain electrode, and a gate electrode of the driver transistor.

In the electronic circuit as described above, the third subcircuit can include a first sub-portion and a second sub-portion.

A first terminal of the first sub-portion is coupled to the scan signal terminal; a second terminal of the first sub-portion is coupled to a signal terminal; and a third terminal of the first sub-portion is coupled to the gate electrode of the driver transistor.

A first terminal of the second sub-portion is coupled to the scan signal terminal; a second terminal of the second sub-portion is coupled to the second power supply terminal; and a third terminal of the second sub-portion is coupled to the drain electrode of the driver transistor.

Herein the first sub-portion is configured to provide a signal from the signal terminal to the gate electrode of the driver transistor under control of the scan signal terminal, wherein the signal has a voltage lower than or equal to a voltage of the second power supply terminal.

Herein the second sub-portion is configured to provide a signal from the second power supply terminal to the drain electrode of the driver transistor under control of the scan signal terminal.

In the embodiments of the electronic circuit as mentioned above, the first sub-portion includes a first switch transistor. A gate electrode of the first switch transistor is coupled to the scan signal terminal; a source electrode of the first switch transistor is coupled to the signal terminal; and a drain electrode of the first switch transistor is coupled to the gate electrode of the driver transistor.

In the embodiments of the electronic circuit as mentioned above, the second sub-portion comprises a second switch transistor. A gate electrode of the second switch transistor is coupled to the scan signal terminal; a source electrode of the second switch transistor is coupled to the second power supply terminal; and a drain electrode of the second switch transistor is coupled to the drain electrode of the driver transistor.

According to some embodiments of the electronic circuit, the signal terminal is the second power supply terminal.

According to some other embodiments of the electronic circuit, the signal terminal is an initial signal terminal, which is configured to provide a signal having a voltage lower than the voltage of the second power supply terminal.

In the electronic circuit, at least one of the first subcircuit, the second subcircuit, or the fifth subcircuit can include a switch transistor.

In embodiments of electronic circuit where the first subcircuit includes a third switch transistor, a gate electrode of the third switch transistor can be coupled to the scan signal terminal; a source electrode of the third switch transistor can be coupled to the data signal terminal; and a drain electrode of the third switch transistor can be coupled to the first node.

In embodiments of electronic circuit where the second subcircuit includes a fourth switch transistor, a gate electrode of the fourth switch transistor is coupled to the first control signal terminal; a source electrode of the fourth switch transistor is coupled to the first power supply terminal; and a drain electrode of the fourth switch transistor is coupled to the second node.

In embodiments of electronic circuit where the fifth subcircuit comprises a fifth switch transistor and a sixth switch transistor, a gate electrode of the fifth switch transistor is coupled to the second control signal terminal; a source electrode of the fifth switch transistor is coupled to the first node; and a drain electrode of the fifth switch transistor is coupled to the gate electrode of the driver transistor; a gate electrode of the sixth switch transistor is coupled to the second control signal terminal; a source electrode of the sixth switch transistor is coupled to the drain electrode of the driver transistor; and a drain electrode of the sixth switch transistor is coupled to the first terminal of the electronic component.

In the electronic circuit, the fourth subcircuit can include a capacitor. A first terminal of the capacitor is coupled to the first node; and a second terminal of the capacitor is coupled to the second node.

In any of the embodiments of the electronic circuit as described above, the driver transistor can be a P-type transistor, and the electronic component can include a light-emitting component.

Herein the light-emitting component can include an organic light-emitting diode (OLED), and the electronic circuit is accordingly configured to maintain the substantially stable working current through the driver transistor independent of a threshold voltage of the driver transistor or a power supply voltage of the first power supply terminal.

In a second aspect, the present disclosure further provides a display panel. The display panel includes an electronic circuit according to any of the embodiments as mentioned above.

In a third aspect, the present disclosure further provides a display apparatus. The display apparatus includes a display panel according to any of the embodiments as mentioned above.

In a fourth aspect, the present disclosure further provides a method of driving the electronic circuit. The method comprises a first stage, a second stage, a third stage, and a fourth stage.

During the first stage, the first subcircuit provides a signal from the data signal terminal to the first node under control of the scan signal terminal; the second subcircuit provides a signal from the first power supply terminal to the second node under control of the first control terminal; the fourth subcircuit charges under control of the signal from the first node and the signal from the second node; and the third subcircuit controls the driver transistor to have a diode connection or a source-follow connection via the signal terminal and the second power supply terminal.

During the second stage, the first subcircuit provides a signal from the data signal terminal to the first node under control of the scan signal terminal; the third subcircuit controls the driver transistor to have a diode connection or a source-follow connection via the signal terminal and the second power supply terminal; and the fourth subcircuit discharges under control of the signal from the first node and the signal from the second node.

During the third stage, the second subcircuit provides a signal from the first power supply terminal to the second node under control of the first control signal terminal; and the fourth subcircuit maintains a stable voltage difference between the first node and the second node when the first node is in a floating state.

During the fourth stage, the second subcircuit provides a signal from the first power supply terminal to the second node under control of the first control signal terminal; and the fifth subcircuit conducts the first node with the gate electrode of the driver transistor and conducts the drain electrode of the driver transistor with the electronic component under control of the second control signal terminal, to thereby control the driver transistor to drive the electronic component.

In the method as described above, during a saturation mode of the driver transistor, the working current flowing through the driver transistor can be independent of a threshold voltage of the driver transistor or a power supply voltage of the first power supply terminal.

According to some embodiments of the method, the signal terminal is an initial signal terminal configured to provide a signal having a voltage lower than the voltage of the second power supply terminal, and the third subcircuit controls the driver transistor to have a source-follow connection via the signal terminal and the second power supply terminal.

Herein, the working current flowing through the driver transistor satisfies the following formula:

$$I_L=K(V_{GS}-V_{th})^2=K[(V_{Data}+V_{DD}-V_{Int}+V_{th}-V_{DD})-V_{th}]^2=K(V_{Data}-V_{Int})^2$$

where IL represents the working current flowing through the driver transistor; $V_{GS}$ represents the gate-source voltage of the driver transistor; K is a structure parameter; $V_{Int}$ represents the voltage of the initial signal terminal Int; $V_{Data}$ represents the voltage of the data signal terminal Data; $V_{th}$ represents the threshold voltage of the driver transistor; and $V_{dd}$ represents the voltage of the first power supply terminal.

According to some other embodiments of the method, the signal terminal is the second power supply terminal, and the third subcircuit controls the driver transistor to have a diode connection.

Herein, the working current flowing through the driver transistor satisfies the following formula:

$$I_L=K(V_{GS}-V_{th})^2=K[(V_{Data}+V_{DD}-V_{EE}+V_{th}-V_{DD})-V_{th}]^2=K(V_{Data}-V_{EE})^2$$

where IL represents the working current flowing through the driver transistor; $V_{GS}$ represents the gate-source voltage of the driver transistor; K is a structure parameter; $V_{EE}$ represents the voltage of the second power supply terminal; $V_{Data}$ represents the voltage of the data signal terminal Data; $V_{th}$ represents the threshold voltage of the driver transistor; and $V_{dd}$ represents the voltage of the first power supply terminal.

In any of the aforementioned embodiments of the method, the electronic component includes a light-emitting component, which can comprise an organic light-emitting diode (OLED).

Other embodiments may become apparent in view of the following descriptions and the attached drawings.

BRIEF DESCRIPTION OF THE DRAWINGS

To more clearly illustrate some of the embodiments disclosed herein, the following is a brief description of the drawings. The drawings in the following descriptions are only illustrative of some embodiments. For those of ordinary skill in the art, other drawings of other embodiments can become apparent based on these drawings.

DETAILED DESCRIPTION

In the following, with reference to the drawings of various embodiments disclosed herein, the technical solutions of the embodiments of the disclosure will be described in a clear and fully understandable way.

It is obvious that the described embodiments are merely a portion but not all the embodiments of the disclosure. Based on the described embodiments of the disclosure, those ordinarily skilled in the art can obtain other embodiment(s), which come(s) within the scope sought for protection by the disclosure.

In a first aspect, the present disclosure provides an electronic circuit, which is configured to maintain a substantially stable working current running through an electronic component.

Figure 1A:
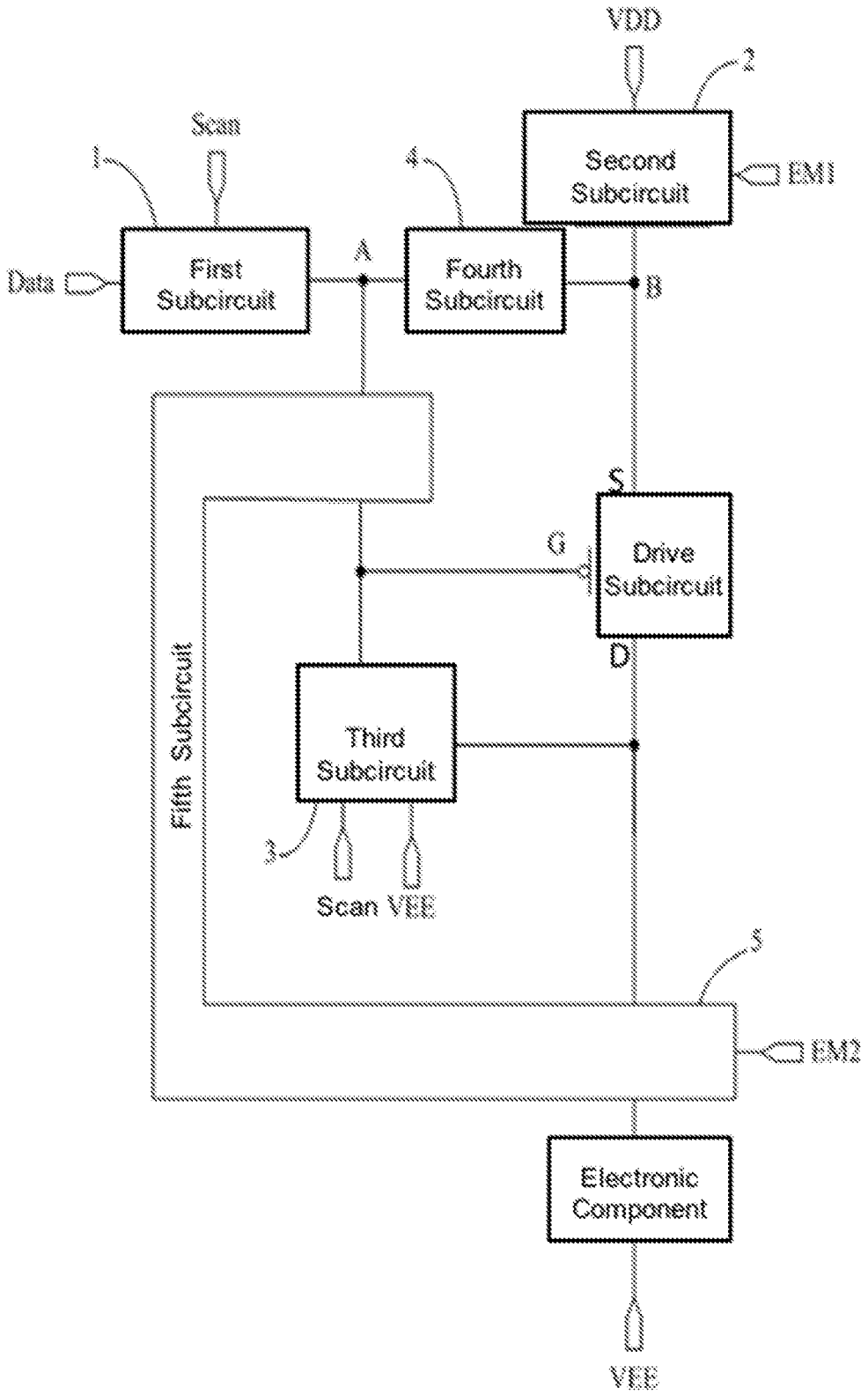
FIG. 1A is a schematic diagram of an electronic circuit according to some other embodiments of the present disclosure.

As illustrated in FIG. 1A, the electronic circuit comprises a drive subcircuit, a first subcircuit, a second subcircuit, a third subcircuit, a fourth subcircuit, and a fifth subcircuit.

The drive subcircuit comprises a first terminal, a second terminal, and a third terminal, wherein the first terminal is coupled to a second node; a current from a first terminal to a second terminal is controlled by a signal from a third terminal, and the drive subcircuit is configured to drive the electronic component via the second terminal;

The first subcircuit is coupled to a data signal terminal, a scan signal terminal and a first node, and is configured to provide a signal from the data signal terminal to the first node under control of the scan signal terminal;

The second subcircuit is coupled to a first power supply terminal, a first control signal terminal and a second node, and is configured to provide a signal from the first power supply terminal to the second node under control of the first control signal terminal;

The third subcircuit is coupled to the scan signal terminal and a second power supply terminal and to the second terminal and the third terminal of the drive subcircuit, and the third subcircuit is configured to control the drive subcircuit to have a diode connection or a source-follow connection via the scan signal terminal and the second power supply terminal;

The fourth subcircuit is coupled to the first node and the second node, and is configured to charge or discharge under control of a signal from the first node and a signal from the second node, and to maintain a stable voltage difference between the first node and the second node if the first node is in a floating state;

The fifth subcircuit is coupled to a second control signal terminal, the first node, the second terminal, and the third terminal, of the drive subcircuit, and a first terminal of the electronic component, and is configured to electrically couple the first node with the third terminal of the drive subcircuit, and to electrically couple the second terminal of the drive subcircuit with the electronic component under control of the second control signal terminal, so as to control the drive subcircuit to drive the electronic component.

Herein the drive subcircuit can be a driver transistor, and the electronic circuit can be a pixel circuit employed in light-emitting component such as an organic light-emitting diode (OLED), and can also be a circuit employed in other types of electronic components. There are no limitations.

In the following, detailed description over the electronic circuit as mentioned above will be provided with pixel circuit as an illustrating example.

Accordingly, in the pixel circuit disclosed herein, the drive subcircuit, the first subcircuit, the second subcircuit, the third subcircuit, and the fourth subcircuit, and the fifth subcircuit as mentioned above in the electronic circuit are respectively a drive subcircuit, a data writing subcircuit, a power supply voltage control subcircuit, a conduction control subcircuit, a storage subcircuit, and a light-emitting control subcircuit.

The scan signal terminal, the data signal terminal, the first control signal terminal, the second control signal terminal, the first power supply terminal, the second power supply terminal, and the signal terminal as mentioned above in the electronic circuit are a scan signal terminal (Scan), a data signal terminal (Data), a first light-emitting control signal terminal (EM1), a second light-emitting control signal terminal (EM2), a first power supply terminal (VDD), a second power supply terminal (VEE), and an signal terminal (Int) in the pixel circuit, respectively.

Figure 1B:
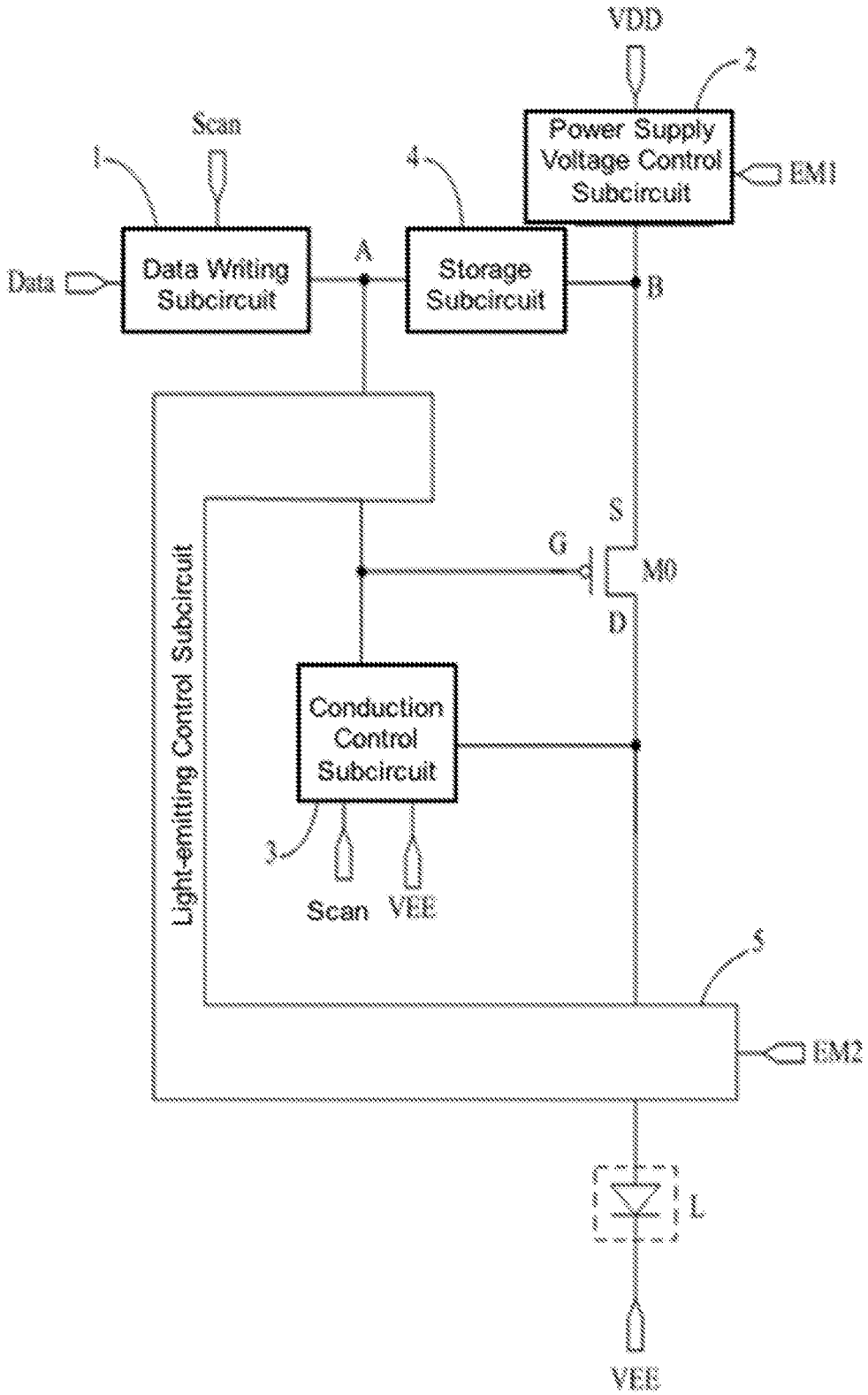
FIG. 1B is a schematic diagram of a pixel circuit according to some embodiments of the present disclosure.

FIG. 1B illustrates a pixel circuit according to some embodiments of the present disclosure. As shown in FIG. 1B, the pixel circuit comprises a data writing subcircuit 1, a power supply voltage control subcircuit 2, a conduction control subcircuit 3, a storage subcircuit 4, a light-emitting control subcircuit 5, a driver transistor M0, and a light-emitting component L. Herein, a subcircuit can be a modular design, and can be referred also as a module. A subcircuit can also be a portion of a circuit, include one or more components, or an electronic device itself.

A first terminal of the data writing subcircuit 1 is electrically coupled to a scan signal terminal Scan; a second terminal of the data writing subcircuit 1 is electrically coupled to a data signal terminal Data; and a third terminal of the data writing subcircuit 1 is electrically coupled to a first node A. The data writing subcircuit 1 is configured to provide a signal from the data signal terminal Data to the first node A under control of the scan signal terminal Scan. The electrical coupling can be realized with a direct electrical connection, such as through a wire, or can be realized through intermediate electronic components such as transistors, capacitors, etc.

A first terminal of the power supply voltage control subcircuit 2 is electrically coupled to a first light-emitting control signal terminal EM1; the second terminal of the power supply voltage control subcircuit 2 is electrically coupled to a first power supply terminal VDD; and a third terminal of the power supply voltage control subcircuit 2 is respectively electrically coupled to a second node B and a source electrode S of the driver transistor M0. The power supply voltage control subcircuit 2 is configured to provide a signal from the first power supply terminal VDD to the second node B under control of the first light-emitting control signal terminal EM1.

A first terminal of the conduction control subcircuit 3 is electrically coupled to an initial signal terminal Int; a second terminal of the conduction control subcircuit 3 is electrically coupled to a second power supply terminal VEE; a third terminal of the conduction control subcircuit 3 is electrically coupled to a gate electrode G of the driver transistor M0; and a fourth terminal of the conduction control subcircuit 3 is electrically coupled to a drain electrode D of the driver transistor M0. The conduction control subcircuit 3 is configured to control the driver transistor M0 to be in a diode state through the initial signal terminal Int and the second power supply terminal VEE.

A first terminal of the storage subcircuit 4 is electrically coupled to the first node A; and a second terminal of the storage subcircuit 4 is electrically coupled to the second node B. The storage subcircuit 4 is configured to charge or discharge under control of both a signal from the first node A and a signal from the second node B, and to maintain a stable voltage difference between the first node A and the second node B when the first node A is in a floating state.

A first terminal of the light-emitting control subcircuit 5 is electrically coupled to a second light-emitting control signal terminal EM2; a second terminal of the light-emitting control subcircuit 5 is electrically coupled to the first node A; a third terminal of the light-emitting control subcircuit 5 is electrically coupled to the gate electrode G of the driver transistor M0; a fourth terminal of the light-emitting control subcircuit 5 is electrically coupled to the drain electrode D of the driver transistor M0; a fifth terminal of the light-emitting control subcircuit 5 is electrically coupled to a first terminal of the light-emitting component L, whereas a second terminal of the light-emitting component L is electrically coupled to the second power supply terminal VEE.

The light-emitting control subcircuit 5 is configured to electrically couple the first node A with the gate electrode G of the driver transistor M0, and to electrically couple the drain electrode D of the driver transistor M0 with the light-emitting component L under the control of the second light-emitting control signal terminal EM2, so as to control the driver transistor M0 to drive the light-emitting component L to emit light.

In the embodiment of the pixel circuit as described above, the pixel circuit comprises a data writing subcircuit, a power supply voltage control subcircuit, a conduction control subcircuit, a storage subcircuit, a light-emitting control subcircuit, the driver transistor, and a light-emitting component.

The data writing subcircuit is configured to provide a signal from the data signal terminal to the first node under control of the scan signal terminal. The power supply voltage control subcircuit is configured to provide a signal from the first power supply terminal to the second node under control of the first light-emitting control signal terminal. The conduction control subcircuit is configured to control the driver transistor to be in a diode state through the initial signal terminal and the second power supply terminal. The storage subcircuit is configured to charge and discharge under the common control of a signal from the first node and a signal from the second node and to maintain a stable voltage difference between the first node and the second node when the first node is in floating state. The light-emitting control subcircuit is configured to electrically couple the first node with the gate electrode of the driver transistor, and to electrically couple the drain electrode of the driver transistor with the light-emitting component to control the driver transistor to drive the light-emitting component to thereby emit light.

In the pixel circuit as described above, through a coordination of the aforementioned five subcircuits and the driver transistor, the working current of the driver transistor in the pixel circuit that drives the light-emitting component to emit light can be allowed to be related only to the voltage of the data signal terminal and the voltage of the initial signal terminal, but not related to the threshold voltage of the driver transistor and the voltage of the first power supply terminal. As such, the influence of the threshold voltage of the driver transistor and the influence of IR Drop to the working current flowing through the light-emitting component can be avoided, thereby the working current that drives the light-emitting component can be maintained to be stable. Therefore, an improved uniformity of the brightness of the images in the display area of the display apparatus can be achieved.

In some embodiments of the pixel circuit as described above, as shown in FIG. 1B, the driver transistor M0 can be a P-type transistor. Because the threshold voltage of a P-type transistor $V_{th}$ is generally a negative value, in order to ensure the driver transistor M0 to work normally, the voltage VDD at the first power supply terminal is generally set as a positive value, and the voltage VEE at the second power supply terminal is generally set as ground (zero), or a negative value.

In some embodiments of the pixel circuit, the voltage of the first power supply terminal VDD is larger than the voltage of the second power supply terminal VEE, and the voltage of the initial signal terminal $V_{Int}$. In addition, the voltage ($V_{dd}$) of the first power supply terminal VDD and the voltage of the initial signal terminal $V_{Int}$ can satisfy: $V_{dd}>V_{Int}-V_{th}$.

In the pixel circuit as described above, the light-emitting component can be an OLED, which emits light upon application of an electric current when the driver transistor is in a saturation mode.

Figure 1C:
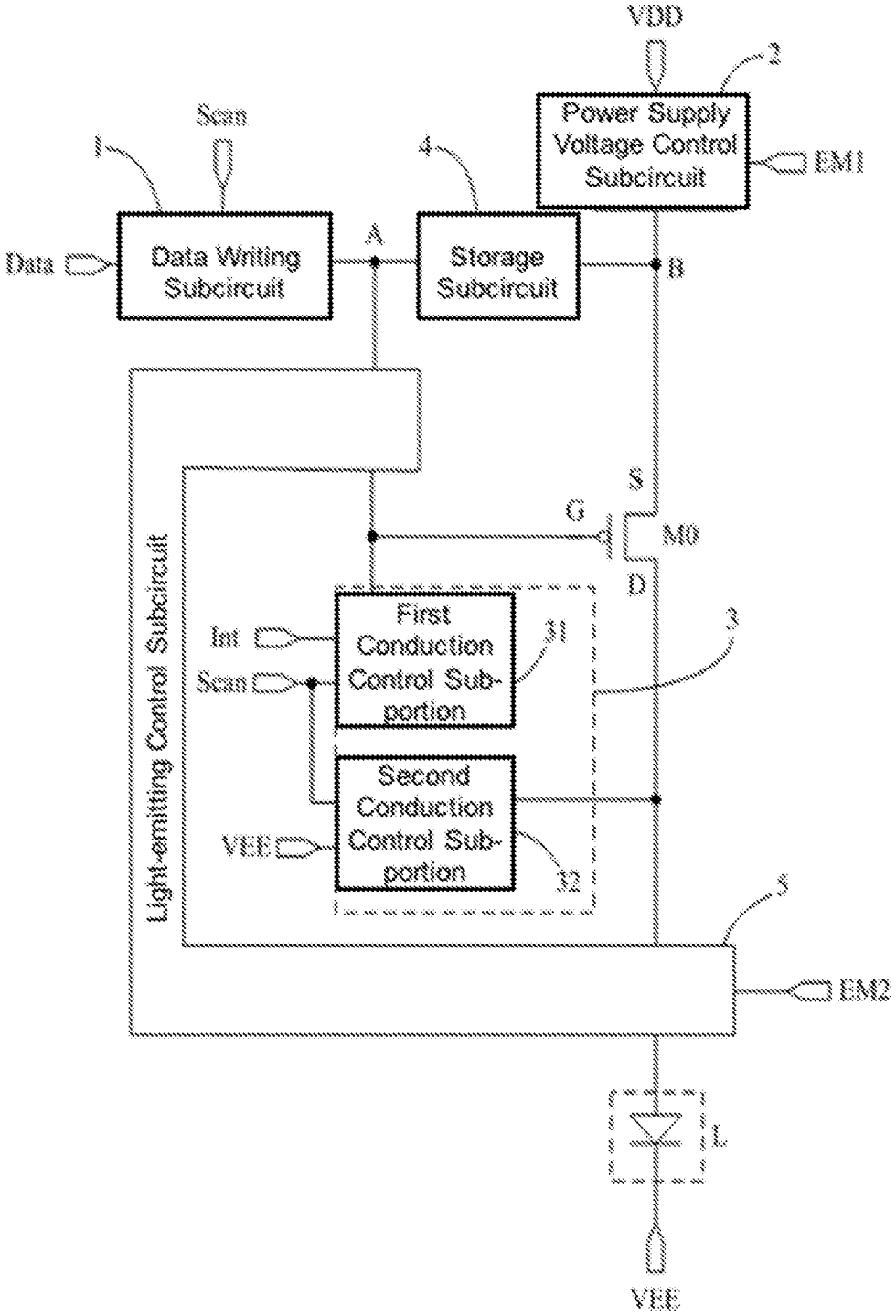
FIG. 1C is a schematic diagram of a pixel circuit according to some other embodiments of the present disclosure.

In some other embodiments of the pixel circuit, as shown in FIG. 1C, the conduction control subcircuit 3 can comprise: a first conduction control sub-portion 31, and a second conduction control sub-portion 32.

A first terminal of the first conduction control sub-portion 31 is electrically coupled to the scan signal terminal Scan; a second terminal of the first conduction control sub-portion 31 is electrically coupled to the initial signal terminal Int; and a third terminal of the first conduction control sub-portion 31 is electrically coupled to the gate electrode G of the driver transistor M0. The first conduction control sub-portion 31 is configured to provide a signal from the initial signal terminal Int to the gate electrode G of the driver transistor M0 under control of the scan signal terminal Scan.

A first terminal of the second conduction control sub-portion 32 is electrically coupled to the scan signal terminal Scan; a second terminal of the second conduction control sub-portion 32 is electrically coupled to the second power supply terminal VEE; and a third terminal of the second conduction control sub-portion 32 is electrically coupled to the drain electrode D of the driver transistor M0. The second conduction control sub-portion 32 is configured to provide a signal from the second power supply terminal VEE to the drain electrode D of the driver transistor M0 under control of the scan signal terminal Scan.

The pixel circuit according to some embodiments disclosed herein will be described in more detail below. It is noted that these specific embodiments or implementations are only for illustrative purposes, and do not impose limitations on the scope of the present disclosure.

For example, in the various embodiments of the pixel circuit as illustrated in FIGS. 2A-2D, the first conduction control sub-portion 31 can comprise a first switch transistor M1.

A gate electrode of the first switch transistor M1 is electrically coupled to the scan signal terminal Scan; a source electrode of the first switch transistor M1 is electrically coupled to the initial signal terminal Int; and a drain electrode of the first switch transistor M1 is electrically coupled to the gate electrode G of the driver transistor M0.

Figure 2A:
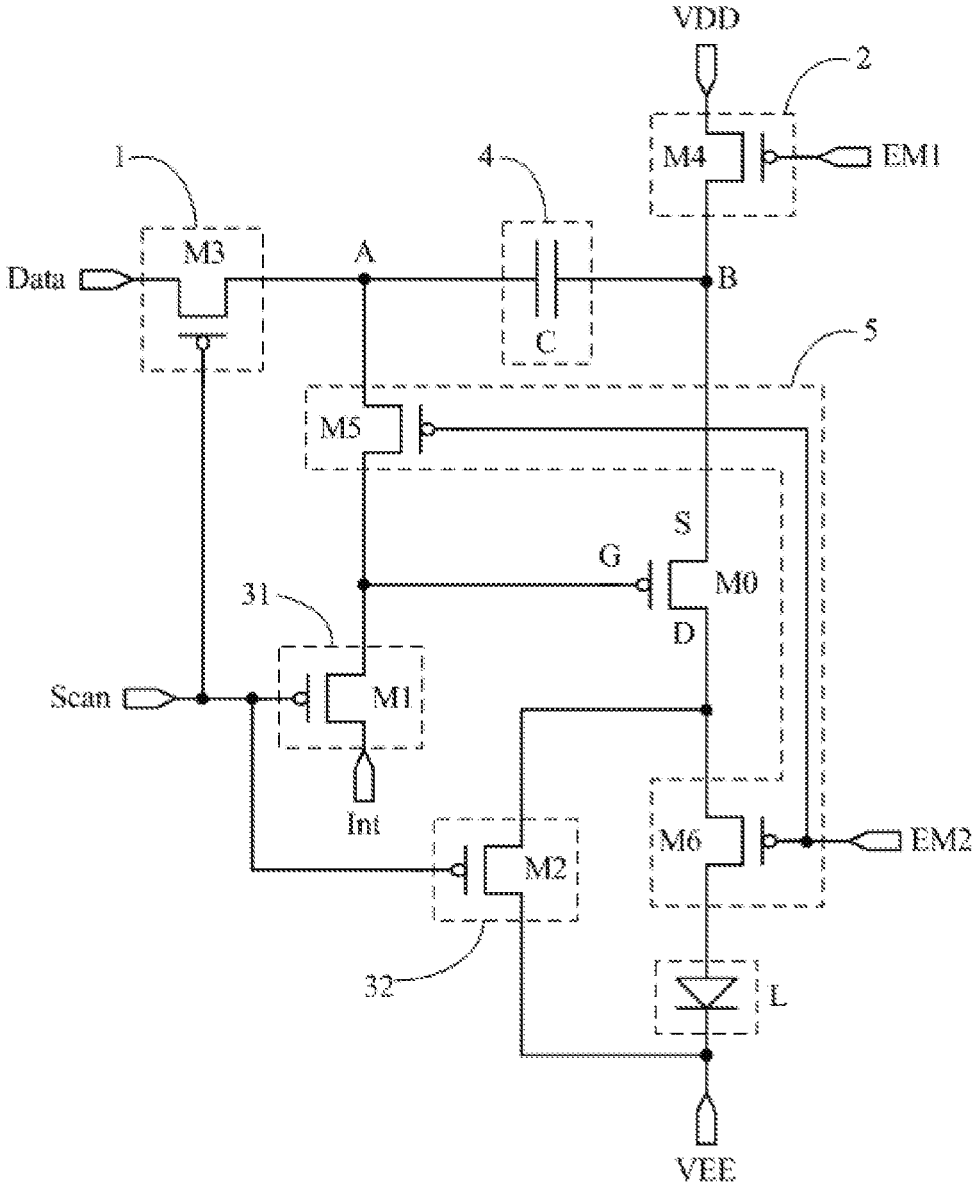
FIG. 2A is a circuit diagram of a pixel circuit according to a first embodiment of the present disclosure.
Figure 2B:
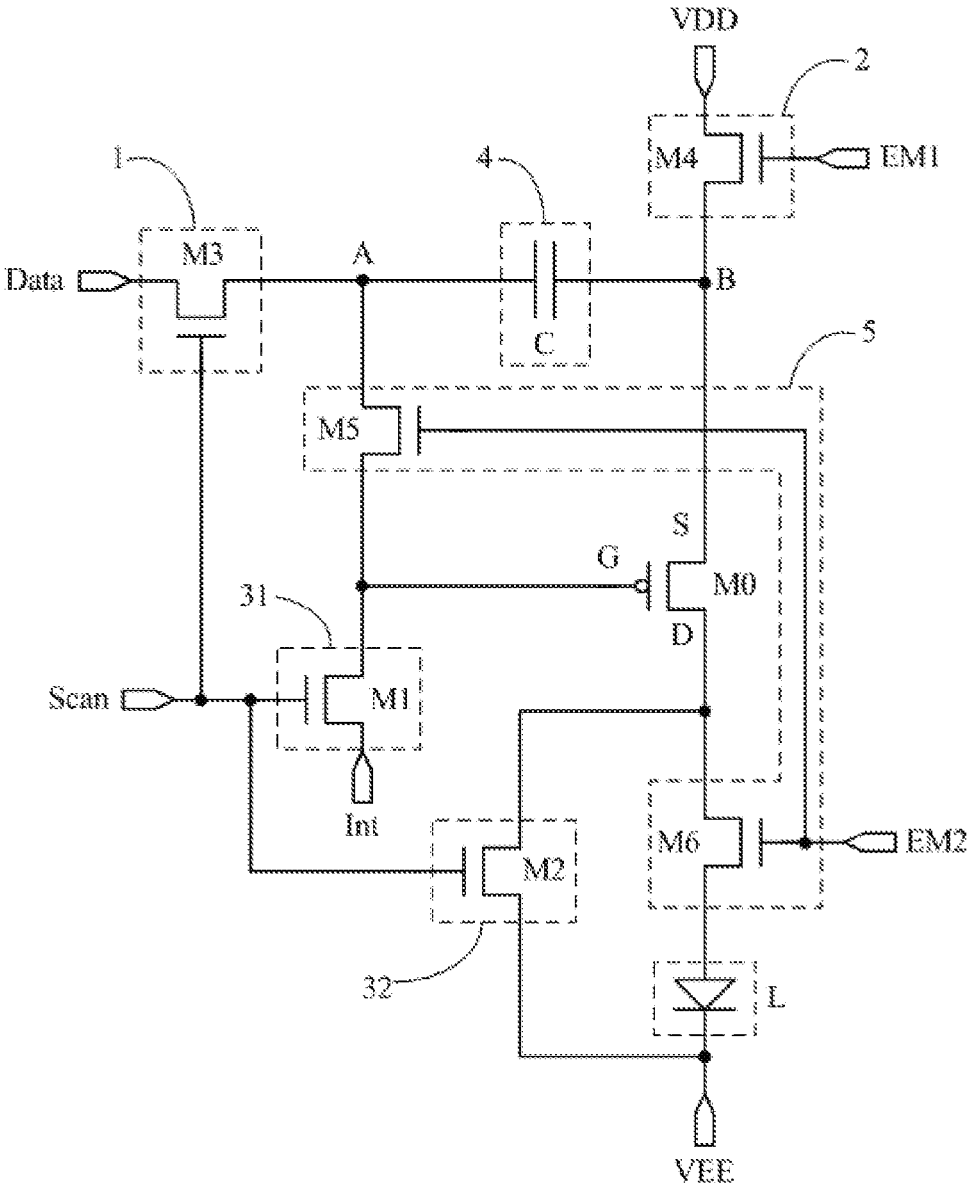
FIG. 2B is a circuit diagram of a pixel circuit according to a second embodiment of the present disclosure.
Figure 2C:
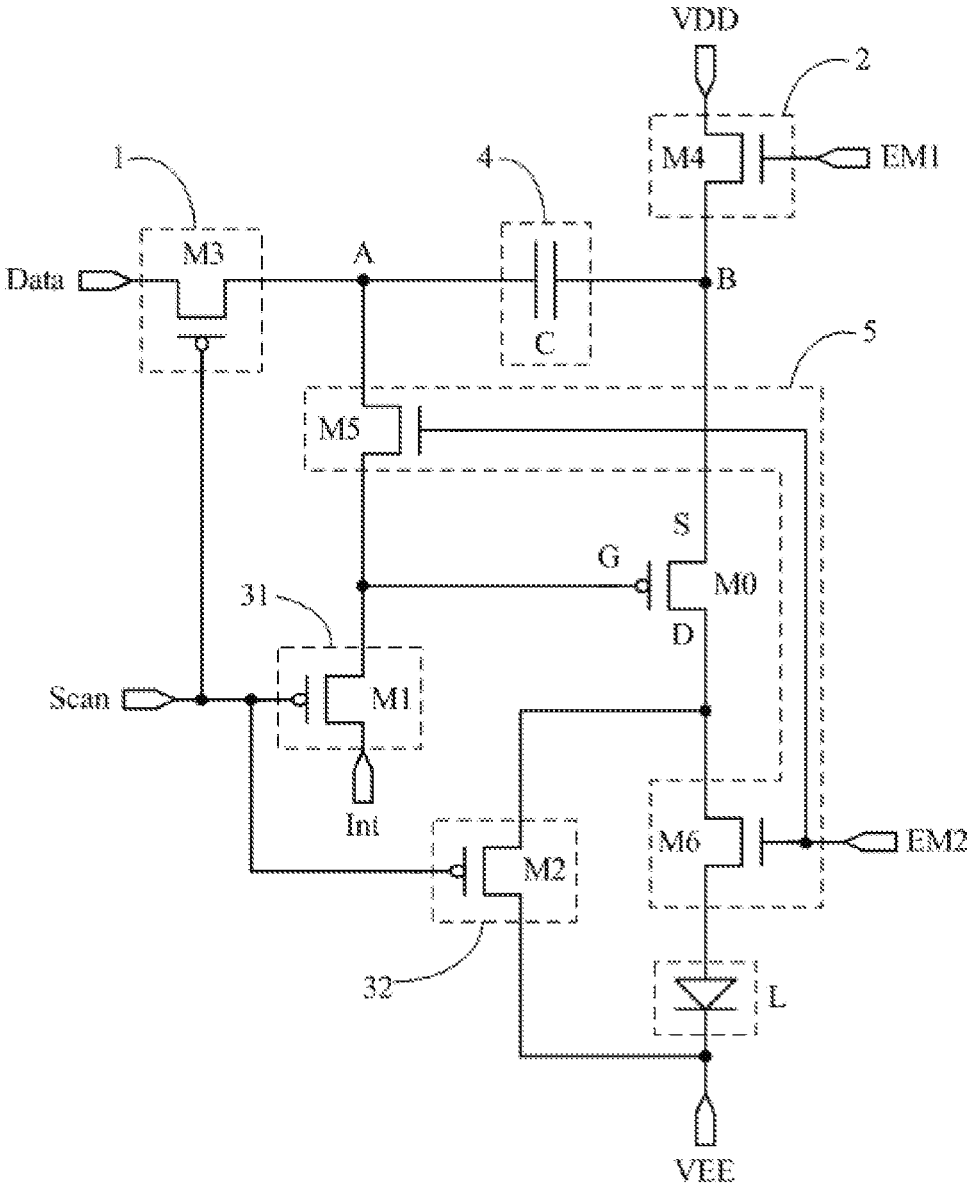
FIG. 2C is a circuit diagram of a pixel circuit according to a third embodiment of the present disclosure.
Figure 2D:
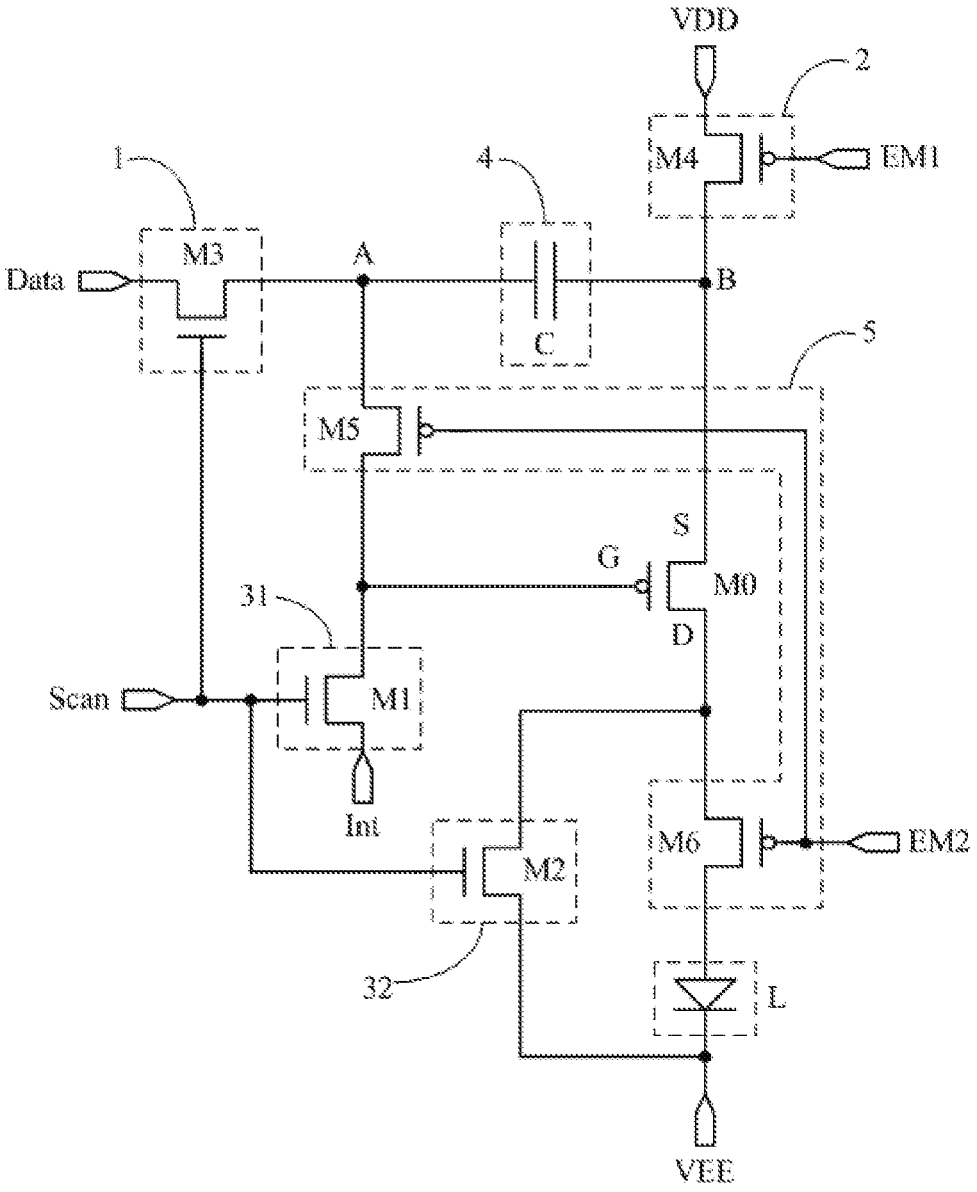
FIG. 2D is a circuit diagram of a pixel circuit according to a fourth embodiment of the present disclosure.

According to some specific implementations of the pixel circuit as shown in FIG. 2A and FIG. 2C, the first switch transistor M1 can be a P-type switch transistor. Alternatively, according to some other specific implementations of the pixel circuit as shown in FIG. 2B and FIG. 2D, the first switch transistor M1 can be an N-type transistor. There are no limitations herein.

In specific implementations, in the pixel circuit according to the aforementioned embodiments of the present disclosure, the first switch transistor M1 can be configured to provide a signal from the initial signal terminal Int to the gate electrode G of the driver transistor M0, when it is in a conductive state under the control of the scan signal terminal SCAN.

It is noted that the above specific embodiments are only examples for illustrating the specific structures of the first conduction control sub-portion in the pixel circuit according to some embodiments of the present disclosure. In practical implementation, the specific structures of the first conduction control sub-portion are not limited to the structures as described above, and can also adopt other structures that can be understood by those skilled in the art. There are no limitations herein.

Specifically, in the various embodiments of the pixel circuit as illustrated in FIGS. 2A-2D, the second conduction control sub-portion 32 can comprise a second switch transistor M2.

A gate electrode of the second switch transistor M2 is electrically coupled to the scan signal terminal Scan; a source electrode of the second switch transistor M2 is electrically coupled to the second power supply terminal VEE; and a drain electrode of the second switch transistor M2 is electrically coupled to the drain electrode D of the driver transistor M0.

According to some specific implementations of the pixel circuit as shown in FIG. 2A and FIG. 2C, the second switch transistor M2 can be a P-type switch transistor. Alternatively, according to some other specific implementations of the pixel circuit as shown in FIG. 2B and FIG. 2D, the second switch transistor M2 can be an N-type transistor. There are no limitations herein.

In some specific implementations, in the pixel circuit according to some embodiments of the present disclosure, the second switch transistor M2 is configured to provide a signal from the second power supply terminal VEE to the drain electrode D of the driver transistor M0, when it is in a conductive state under control of the scan signal terminal SCAN.

In the embodiments of the pixel circuit as shown in any one of FIGS. 2A-2D, where the first conduction control sub-portion 31 comprises the first switch transistor M1, and the second conduction control sub-portion 32 comprises the second switch transistor M2, if a signal from the scan signal terminal SCAN turns on the first switch transistor M1 and the second switch transistor M2, the gate electrode G of the driver transistor M0 is conductive with the initial signal terminal Int, and the drain electrode D of the driver transistor M0 is conductive with the second power supply terminal VEE, thereby realizing a source-follow connection for the driver transistor M0. It is noted that in order to ensure the source-follow connection for the driver transistor M0, it is required that $V_{Int}<V_{EE}$.

Herein by such a configuration, it substantially realizes a source-follow connection for the driver transistor M0 under control of the scan signal terminal SCAN, the initial signal terminal Int, and the second power supply terminal VEE, which causes the threshold voltage ($V_{th}$) of the driver transistor M0 to be compensated to thereby allow the working current flowing through the driver transistor M0 to be unaffected by the threshold voltage ($V_{th}$) of driver transistor M0 and thus become substantially stable.

It is noted that besides the above embodiments of the pixel circuit as shown in FIGS. 2A-2D, other embodiments are also possible.

Figure 2E:
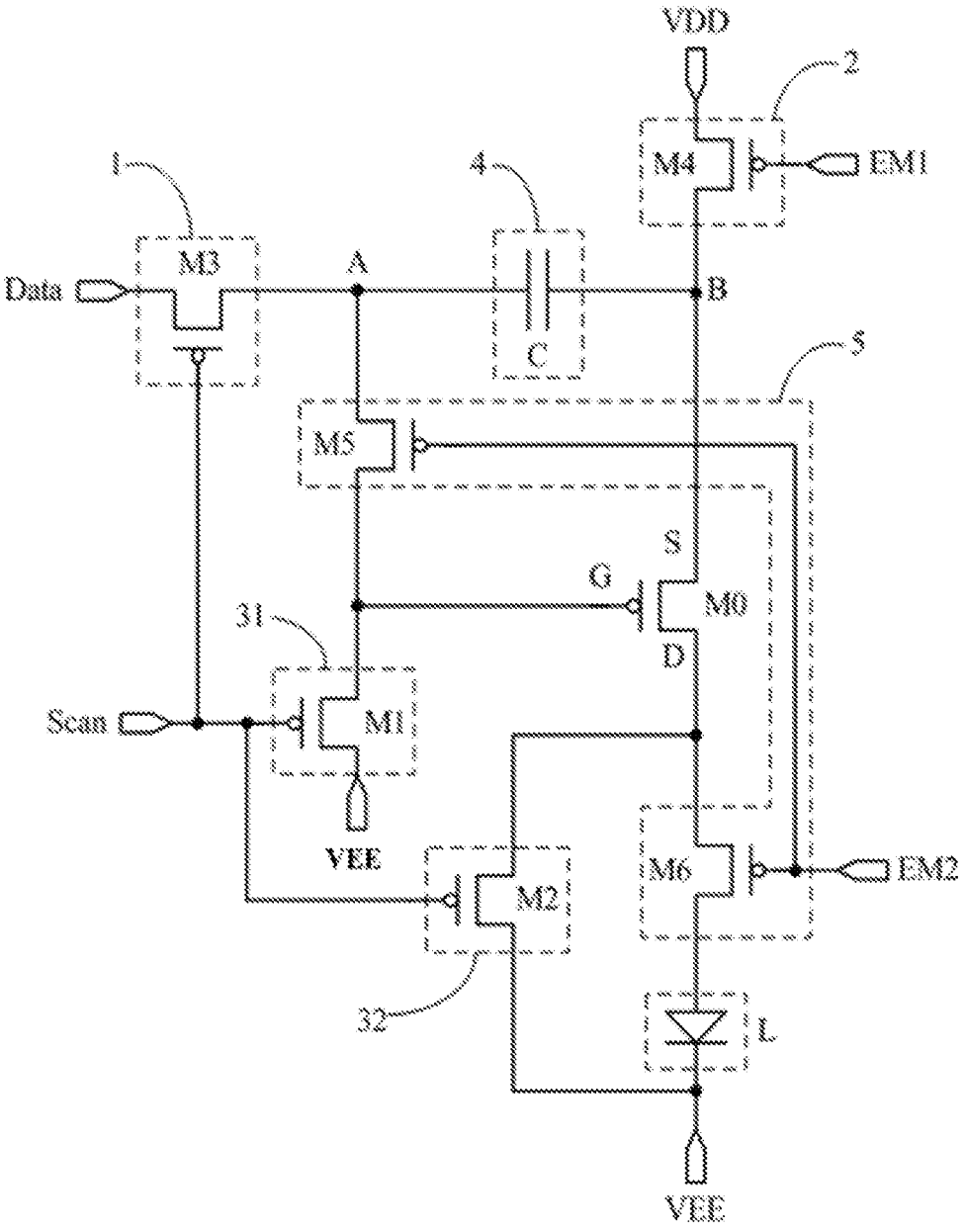
FIG. 2E is a circuit diagram of a pixel circuit according to a fifth embodiment of the present disclosure.

In one embodiment, as shown in FIG. 2E, the circuit diagram for the second switch transistor M2 is substantially identical to the embodiments shown in FIGS. 2A-2D (i.e., a gate electrode of the second switch transistor M2 is electrically coupled to the scan signal terminal Scan; a source electrode of the second switch transistor M2 is electrically coupled to the second power supply terminal VEE; and a drain electrode of the second switch transistor M2 is electrically coupled to the drain electrode D of the driver transistor M0). Yet the circuit diagram for the first switch transistor M1 differs from the embodiments shown in FIGS. 2A-2D by having a source electrode of the first switch transistor M1 electrically coupled to the second power supply terminal VEE, while other connections are substantially same (i.e. gate electrode of the first switch transistor M1 is electrically coupled to the scan signal terminal Scan; a drain electrode of the first switch transistor M1 is electrically coupled to the gate electrode G of the driver transistor M0).

Figure 2F:
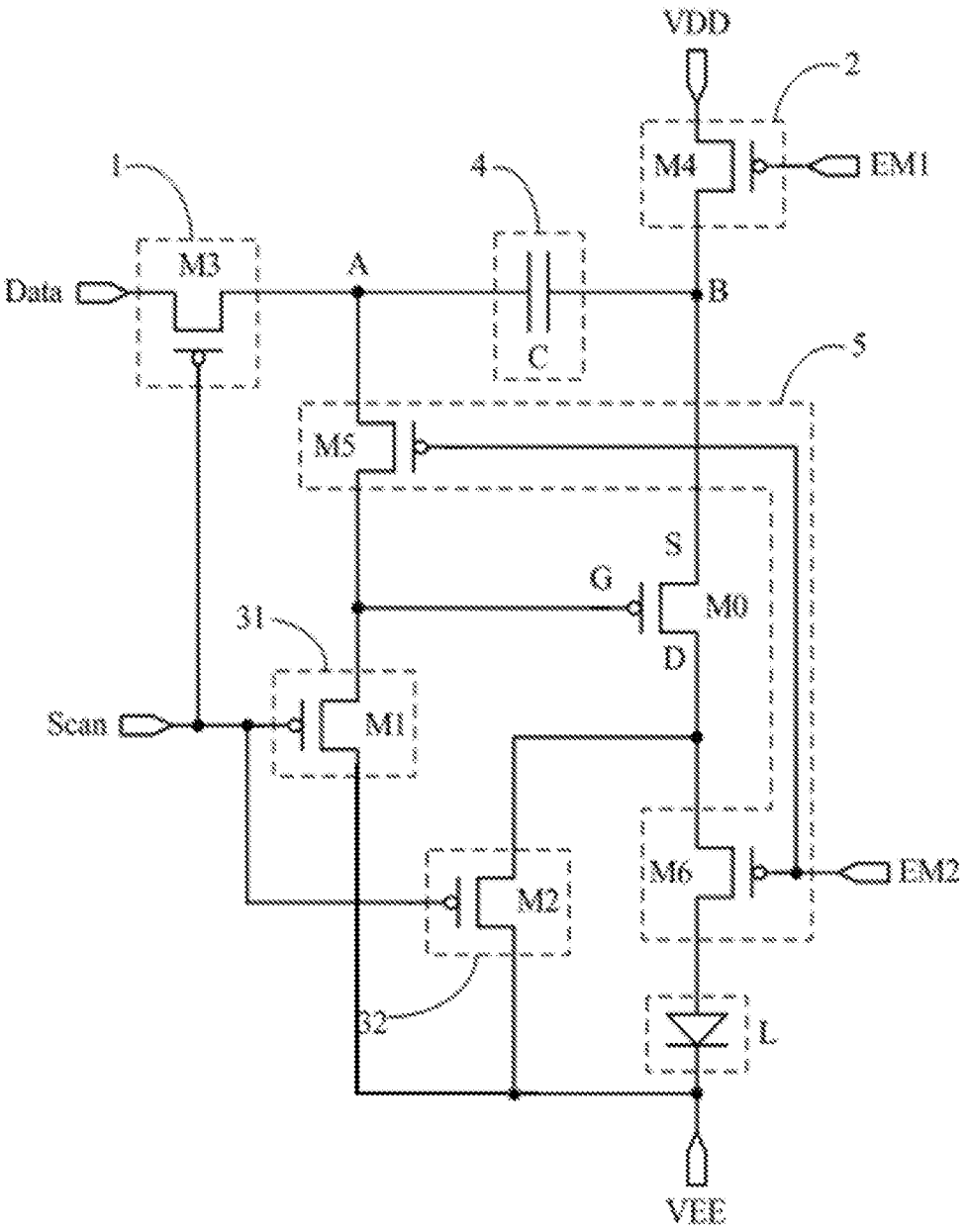
FIG. 2F is a circuit diagram of a pixel circuit according to a sixth embodiment of the present disclosure.

In another embodiment as shown in FIG. 2F, the circuit diagram for the second switch transistor M2 is substantially identical to the embodiments shown in FIGS. 2A-2D (i.e., a gate electrode of the second switch transistor M2 is electrically coupled to the scan signal terminal Scan; a source electrode of the second switch transistor M2 is electrically coupled to the second power supply terminal VEE; and a drain electrode of the second switch transistor M2 is electrically coupled to the drain electrode D of the driver transistor M0). Yet the circuit diagram for the first switch transistor M1 differs from the embodiments shown in FIGS. 2A-2D by having a source electrode of the first switch transistor M1 electrically coupled to the source electrode of the second switch transistor M2, while other connections are substantially same (i.e. gate electrode of the first switch transistor M1 is electrically coupled to the scan signal terminal Scan; a drain electrode of the first switch transistor M1 is electrically coupled to the gate electrode G of the driver transistor M0).

In both the embodiments as mentioned above and as illustrated in FIG. 2E and FIG. 2F, the source electrode of the first switch transistor M1 is electrically coupled to the second power supply terminal VEE. As such, when the scan signal terminal SCAN turns on the first switch transistor M1 and the second switch transistor M2, the gate electrode G of the driver transistor M0 is electrically coupled to the second power supply terminal VEE via the first switch transistor M1, and the drain electrode D of the driver transistor M0 is also electrically coupled to the second power supply terminal VEE via the second switch transistor M2, thereby equaling to a connection between the gate electrode G and the drain electrode D of the driver transistor M0.

Herein by such a configuration, it substantially realizes a diode connection for the driver transistor M0 under control of the scan signal terminal SCAN and the second power supply terminal VEE, which causes the threshold voltage ($V_{th}$) of the driver transistor M0 to be compensated to thereby allow the working current flowing through the driver transistor M0 to be unaffected by the threshold voltage ($V_{th}$) of driver transistor M0 and thus become substantially stable.

It is noted that the above specific embodiments are only examples for illustrating the specific structures of the second conduction control sub-portion in the pixel circuit according to some embodiments of the present disclosure. In practical implementations, the specific structures of the second conduction control sub-portion are not limited to the structures as described above, and can also adopt other structures that can be understood by those skilled in the art. There are no limitations herein.

In the various embodiments of the pixel circuit as illustrated in FIGS. 2A-2F, the data writing subcircuit 1 can comprise a third switch transistor M3 according to some implementations.

A gate electrode of the third switch transistor M3 is electrically coupled to the scan signal terminal Scan; a source electrode of the third switch transistor M3 is electrically coupled to the data signal terminal Data; and a drain electrode of the third switch transistor M3 is electrically coupled to the first node A.

According to some specific implementations of the pixel circuit as shown in FIG. 2A and FIG. 2C, the third switch transistor M3 can be a P-type switch transistor. Alternatively, according to some other specific embodiments of the pixel circuit as shown in FIG. 2B and FIG. 2D, the third switch transistor M3 can also be an N-type switch transistor. There are no limitations herein.

In some specific implementations, in the pixel circuit according to some embodiments of the present disclosure, the third switch transistor can be configured to provide a signal from the data signal terminal to the first node when it is in a conductive state under control of the scan signal terminal.

It is noted that the above specific embodiments are only examples for illustrating the specific structures of the data writing subcircuit in the pixel circuit according to some embodiments of the present disclosure. In practical implementations, the specific structures of the data writing subcircuit are not limited to the structures as described above, and can also adopt other structures that can be understood by those skilled in the art. There are no limitations herein.

In some specific implementations, in the pixel circuit as illustrated in FIGS. 2A-2F, the power supply voltage control subcircuit 2 can comprise a fourth switch transistor M4.

A gate electrode of the fourth switch transistor M4 is electrically coupled to the first light-emitting control signal terminal EM1; a source electrode of the fourth switch transistor M4 is electrically coupled to the first power supply terminal VDD; and a drain electrode of the fourth switch transistor M4 is electrically coupled to the second node B.

According to some specific implementations of the pixel circuit as shown in FIG. 2A and FIG. 2D, the fourth switch transistor M4 can be a P-type switch transistor. Alternatively, according to some other specific embodiments of the pixel circuit as shown in as shown in FIG. 2B and FIG. 2C, the fourth switch transistor M4 can also be an N-type switch transistor. There are no limitations herein.

In some specific implementations of the pixel circuit, the fourth switch transistor can be configured to provide a signal from the first power supply terminal to the second node, when it is in a conductive state under control of the first light-emitting control signal terminal.

It is noted that the above specific embodiments are only examples for illustrating the specific structures of the power supply voltage control subcircuit in the pixel circuit according to some embodiments of the present disclosure. In practical implementation, the specific structures of the power supply voltage control subcircuit are not limited to the structures as described above, and can also adopt other structures that can be understood by those skilled in the art. There are no limitations herein.

For example, in the various embodiments of the pixel circuit as illustrated in FIGS. 2A-2D, the light-emitting control subcircuit 5 can specifically comprise a fifth switch transistor M5, and a sixth switch transistor M6.

A gate electrode of the fifth switch transistor M5 is electrically coupled to the second light-emitting control signal terminal EM2; a source electrode of the fifth switch transistor M5 is electrically coupled to the first node A; and a drain electrode of the fifth switch transistor M5 is electrically coupled to the gate electrode G of the driver transistor M0.

A gate electrode of the sixth switch transistor M6 is electrically coupled to the second light-emitting control signal terminal EM2; a source electrode of the sixth switch transistor M6 is electrically coupled to the drain electrode D of the driver transistor M0; and a drain electrode of the sixth switch transistor M6 is electrically coupled to the first terminal of the light-emitting component L.

According to some specific implementations of the pixel circuit as shown in FIG. 2A and FIG. 2D, the fifth switch transistor M5 and the sixth switch transistor M6 can be P-type transistors. Alternatively, according to some other specific implementations of the pixel circuit as shown in FIG. 2B and FIG. 2C, the fifth switch transistor M5 and the sixth switch transistor M6 can also be N-type transistors. There are no limitations herein.

In some specific implementations, the fifth switch transistor can be configured, when the fifth switch transistor is in a conductive state under the control of the second light-emitting control signal terminal, to electrically couple the first node with the second node to thereby provide a signal from the first node to the second node, and to thereby at least provide the threshold voltage of the driver transistor and the voltage of the first power supply terminal to the gate electrode of the driver transistor.

The sixth switch transistor can be configured, when the sixth switch transistor is in a conductive state under control of the second light-emitting control signal terminal, to electrically couple the drain electrode of the driver transistor with the light-emitting component to thereby control the driver transistor to drive the light-emitting component to emit light.

It is noted that the above specific embodiments are only examples for illustrating the specific structures of the light-emitting control subcircuit in the pixel circuit according to some embodiments of the present disclosure. In practical implementations, the specific structures of the light-emitting control subcircuit are not limited to the structures as described above, and can also adopt other structures that can be understood by those skilled in the art. There are no limitations herein.

In some implementations of the pixel circuit as illustrated in FIGS. 2A-2F, the storage subcircuit 4 can comprise a capacitor C.

A first terminal of the capacitor C is electrically coupled to the first node A; and a second terminal of the capacitor C is electrically coupled to the second node B.

In specific implementations of the pixel circuit, the capacitor is configured to charge under the common control of a signal from the first node and a signal from the second node; to discharge under the common control of a signal from the first node and a signal from the second node; and, when the first node is in a floating state, to maintain a stable voltage difference between the first node and the second node such that the threshold voltage of the driver transistor $V_{th}$ and the voltage of the first power supply terminal $V_{dd}$ can be stored at the first node.

It is noted that the abovementioned embodiments are only examples for illustrating some specific structures of the storage subcircuit in the pixel circuit. In practical implementations, the specific structures of the storage subcircuit are not limited to the structures as described above, and can also adopt other structures that can be understood by those skilled in the art. There are no limitations herein.

In some embodiments of the pixel circuit as described above, such as that shown in FIG. 2A, all switch transistors can be P-type transistors. In some other embodiments, such as that shown in FIG. 2B, all switch transistors can be N-type transistors. There are no limitations herein.

For example, as the driver transistor M0 is selected to be a P-type transistor, as shown in FIG. 2A, all switch transistors can be selected to be P-type transistors. As such, the manufacturing process of the pixel circuit can be simplified.

The P-type switch transistors are OFF upon application of a high electric potential (i.e., under a high voltage), and are ON upon application of a low electric potential (i.e., under a low voltage). Conversely, the N-type switch transistors are ON upon application of a high electric potential (i.e., under a high voltage), and are OFF upon application of a low electric potential (i.e., under a low voltage). As such, for the different selections of the P-type transistors or N-type transistors, the control voltages can be selected accordingly.

The driver transistor and the switch transistors can be thin-film transistors (TFTs), or can be metal oxide semiconductors (MOS), and there are no limitations herein.

In some implementations, the functions of the source electrodes and the drain electrodes of these switch transistors can be interchangeable, depending on the types of the switch transistor and the signals of the signal terminal, and thus they will not be specifically distinguished herein. In the following illustrative examples, both the driver transistor and the switch transistor are thin-film transistors.

In the following, using the pixel circuit shown in FIG. 2A and FIG. 2B as examples and with reference to time sequence diagrams, the working process of the pixel circuit according to some embodiments will be described in detail.

It should be noted that in the following descriptions, 1 represents a high electric potential, and 0 represents a low electric potential. It should be further noted that 1 and 0 represent logic electric potentials, and are configured to better explain the specific working process of some of the embodiments of the present disclosure. Therefore, the numerals "1" and "0" are not necessarily the actual electric potentials applied to the gate electrodes of each of the switch transistors.

Embodiment 1

As shown in FIG. 2A, the driver transistor M0 is a P-type transistor, and all of the switch transistors are P-type transistors. As such, each of the switch transistors is OFF upon application of a high electric potential, and ON upon application of a low electric potential. A corresponding input time sequence diagram is illustrated in FIG. 3A.

Figure 3A:
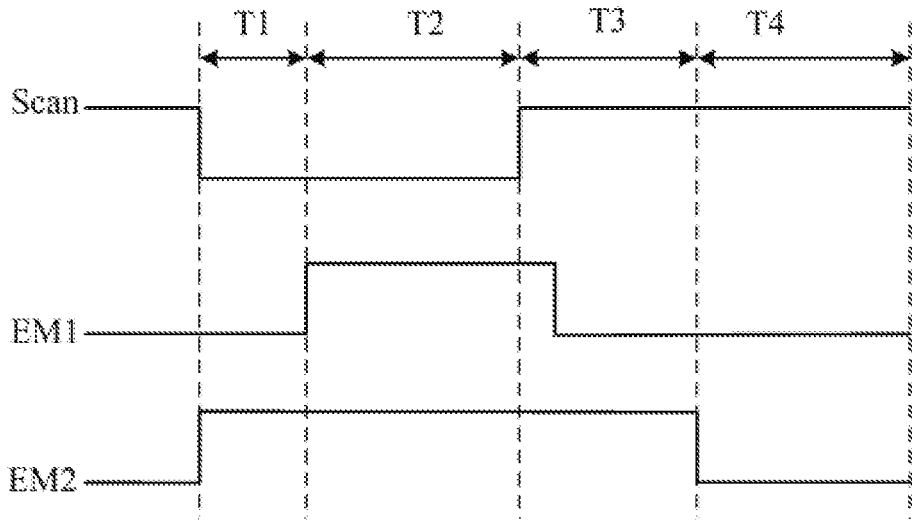
FIG. 3A is a time sequence diagram of the pixel circuit as shown in FIG. 2A.

Specifically, four stages T1, T2, T3 and T4 as shown in the input time sequence diagram of FIG. 3A are used as examples for the following description.

During T1 stage, Scan=0, EM1=0, EM2=1.

Because Scan=0, the first switch transistor M1, the second switch transistor M2, and the third switch transistor M3 are all ON; because EM1=0, the fourth switch transistor M4 is ON; because EM2=1, the fifth switch transistor M5 and the sixth switch transistor M6 are both OFF.

The third switch transistor M3 that is ON provides the voltage of the data signal terminal Data $V_{Data}$ to the first node A, that is, the first terminal of the capacitor C, and as such, the voltage of the first terminal of the capacitor C is $V_{Data}$.

The fourth switch transistor M4 that is ON provides the voltage of the first power supply terminal VDD $V_{dd}$ to the second node B, that is, the source electrode S of the driver transistor M0 and the second terminal of the capacitor C, and as such, the voltage of the second terminal of the capacitor C is $V_{dd}$.

The first switch transistor M1 that is ON provides the voltage of the initial signal terminal Int $V_{Int}$ to the gate electrode G of the driver transistor M0.

The second switch transistor M2 that is ON provides the voltage $V_{ee}$ of the second power supply terminal VEE to the drain electrode D of the driver transistor M0 to control the driver transistor M0 to be in a diode state to thereby ensure that the current flowing from the source electrode to the drain electrode of the driver transistor M0 is stable.

However, because the sixth switch transistor M6 is OFF, the light-emitting component L does not emit light.

During T2 stage, Scan=0, EM1=1, EM2=1.

Because Scan=0, the first switch transistor M1, the second switch transistor M2 and the third switch transistor M3 are all ON; because EM2=1, the fifth switch transistor M5, the sixth switch transistor M6 are both OFF; and because EM1=1, the fourth switch transistor M4 is OFF.

The third switch transistor M3 that is ON provides the voltage $V_{Data}$ of the data signal terminal Data to the first node A, that is, the first terminal of the capacitor C, therefore the voltage of the first terminal of the capacitance C is $V_{Data}$.

The fourth switch transistor M4 that is OFF disconnects the first power supply terminal VDD with the second node B, therefore the second node B is in a floating state.

The first switch transistor M1 that is ON provides the voltage of the initial signal terminal Int to the gate electrode G of the driver transistor M0.

The second switch transistor M2 that is ON provides the voltage $V_{ee}$ of the second power supply terminal VEE to the drain electrode D of the driver transistor M0 to thereby control the driver transistor M0 to be in a diode state.

Because the gate-source voltage of the driver transistor M0 is larger than its threshold voltage $V_{th}$, the driver transistor M0 is turned ON. Because the driver transistor M0 is in the diode state, the capacitor C discharges through the driver transistor M0, until the voltage of the second node B, i.e., the voltage of the second terminal of the capacitor C becomes: $V_{Int}-V_{th}$, when the driver transistor M0 is OFF, and the capacitor C stops discharging. Therefore the voltage difference between the two terminals of the capacitor C is: $V_{Data}-V_{Int}+V_{th}$.

During T3 stage, during the first half of the time period, Scan=1, EM1=1, EM2=1.

Because Scan=1, the first switch transistor M1, the second switch transistor M2 and the third switch transistor M3 are all OFF; because EM=1, the fourth switch transistor is OFF; because EM2=1, the fifth switch transistor and the sixth switch transistor are both OFF.

During T3 stage, during the second half of the time period, Scan=1, EM1=0, EM2=1.

Because Scan=1, the first switch transistor M1, the second switch transistor M2 and the third switch transistor M3 are all OFF; because EM2=1, the fifth switch transistor M5 and the sixth switch transistor M6 are both OFF; because EM1=0, the fourth switch transistor M4 is ON.

The fourth switch transistor M4 that is ON provides the voltage $V_{dd}$ of the first power supply terminal VDD to the second node B, therefore the voltage of the second node B, that is, the voltage of the second terminal of the capacitor, is $V_{dd}$.

The third switch transistor M3 that is OFF disconnects the data signal terminal Data with the first node A, therefore the first node A is in a floating state.

Because the first node A is in the floating state, according to the capacitor coupling principle, in order to maintain the voltage difference between the two terminals of the capacitor as: $V_{Data}-V_{Int}+V_{th}$, the voltage of the first terminal of the capacitor C has a sudden change from $V_{Data}$ to $V_{Data}+V_{dd}-V_{Int}+V_{th}$.

During T4 stage, Scan=1, EM1=0, EM2=0.

Because Scan=1, the first switch transistor M1, the second switch transistor M2 and the third switch transistor M3 are all OFF; because EM2=0, the fifth switch transistor M5 and the sixth switch transistor M6 are both ON; because EM1=0, the fourth switch transistor M4 is ON.

The fifth switch transistor that is ON provides the voltage of the first node A, that is, the voltage $V_{Data}+V_{dd}-V_{Int}+V_{th}$ of the first terminal of the capacitor, to the second node B, therefore the voltage of the gate electrode G of the driver transistor M0 is $V_{Data}+V_{dd}-V_{Int}V_{th}$.

The fourth switch transistor M4 that is ON provides the voltage of the first power supply terminal VDD $V_{dd}$ to the second node B, therefore the voltage of the source electrode D of the driver transistor M0 is $V_{dd}$.

Because the driver transistor M0 is in a saturated state, it can be known that based on the characteristics of currents in a saturated state, the working current $I_L$ flowing through the driver transistor M0 satisfies:

$$I_L=K(V_{GS}-V_{th})^2=K[(V_{Data}+V_{dd}-V_{Int}+V_{th}]^2=K(V_{Data}-V_{Int})^2$$

wherein $V_{GS}$ represents the gate-source voltage of the driver transistor M0; K the structure parameter. Because the value of K is relatively stable in same structures, it can be treated as a constant value.

It can be known from the above formula that, when the driver transistor M0 is in a saturated state, the current is only related to the voltage $V_{Int}$ of the initial signal terminal Int and the voltage $V_{Data}$ of the data signal terminal Data, but not related to the threshold voltage $V_{th}$ of the driver transistor M0 and the voltage $V_{dd}$ of the first power supply terminal VDD.

As such, the problem associated with drifting of the threshold voltage $V_{th}$ that is caused by the manufacturing process and/or the long-time operation of the driver transistor M0, as well as the influence of IR Drop on the current flowing through the light-emitting component, can be effectively solved. Thereby the working current of the light-emitting component L can be kept stable, in turn ensuring the normal functioning of the light-emitting component L.

Embodiment 2

As shown in FIG. 2B, the driver transistor M0 can be a P-type transistor, and all switch transistors can be N-type switch transistors. Each of the switch transistors is ON upon application of a high electric potential, and is OFF upon application of a low electric potential. A corresponding input time sequence diagram is shown in FIG. 3B.

Figure 3B:
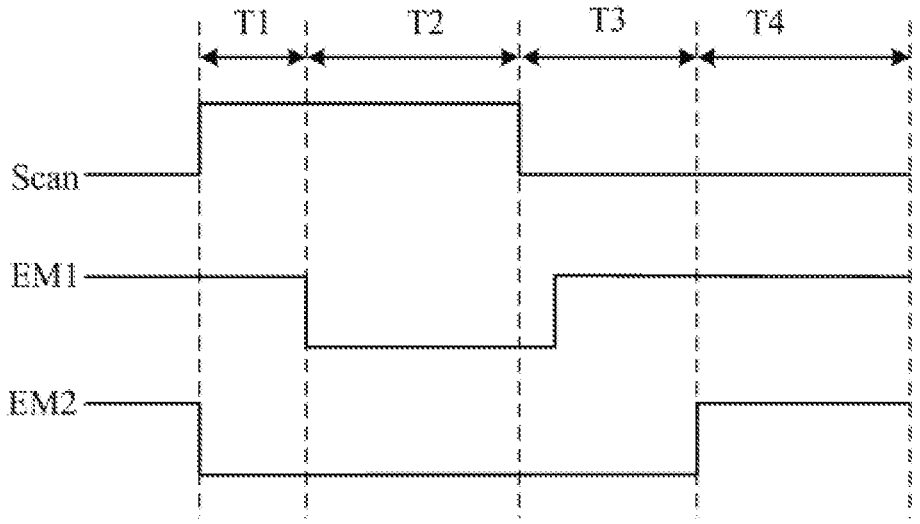
FIG. 3B is a time sequence diagram of the pixel circuit as shown in FIG. 2B.

Specifically, the four stages T1, T2, T3, T4 in the input time sequence diagram as shown in FIG. 3B are selected for detailed description.

During T1 stage, Scan=1, EM1=1, EM2=0.

Because Scan=1, the first switch transistor M1, the second switch transistor M2 and the third switch transistor M3 are all ON; because EM1=1, the fourth switch transistor M4 is ON; because EM2=0, the fifth switch transistor M5 and the sixth switch transistor M6 are both OFF.

The third switch transistor M3 that is ON provides the voltage $V_{Data}$ of the data signal terminal Data to the first node A, that is, the first terminal of the capacitor C, therefore the voltage of the first terminal of the capacitor C is $V_{Data}$.

The fourth switch transistor M4 that is ON provides the voltage $V_{dd}$ of the first power supply terminal VDD to the second node B, that is, the source electrode S of the driver transistor M0 and the second terminal of the capacitor C, therefore the voltage of the second terminal of the capacitor C is $V_{dd}$.

The first switch transistor M1 that is ON provides the voltage $V_{Int}$ of the initial signal terminal Int to the gate electrode G of the driver transistor M0.

The second switch transistor M2 that is ON provides the voltage $V_{ee}$ of the second power supply terminal VEE to the drain electrode D of the driver transistor M0 to thereby control the driver transistor M0 to be in a diode state to have a stable current flowing from its source electrode to its drain electrode.

However, because the sixth switch transistor M6 is OFF, the light-emitting component L does not emit light.

During T2 stage, Scan=1, EM1=0, EM2=0.

Because Scan=1, the first switch transistor M1, the second switch transistor M2 and the third switch transistor M3 are all ON; because EM2=0, the fifth switch transistor M5 and the sixth switch transistor M6 are both OFF; because EM1=0, the fourth switch transistor M4 is OFF.

The third switch transistor M3 that is ON provides the voltage $V_{Data}$ of the data signal terminal Data to the first node A, that is, the first terminal of the capacitor C, therefore the voltage of the first terminal of the capacitor C is $V_{Data}$.

The fourth switch transistor M4 that is OFF disconnects the first power supply terminal VDD from the second node B, therefore the second node B is in a floating state.

The first switch transistor M1 that is ON provides the voltage $V_{Int}$ of the initial signal terminal Int to the gate electrode G of the driver transistor M0.

The second switch transistor M2 that is ON provides the voltage $V_{ee}$ of the second power supply terminal VEE to the drain electrode D of the driver transistor M0 to thereby control the driver transistor M0 to be in a diode state.

Because the gate-source voltage of the driver transistor M0 is larger than its threshold voltage $V_{th}$, the driver transistor M0 is turned ON. Because the driver transistor M0 is in a diode state, the capacitor C discharges through the driver transistor M0, until the voltage of the second node B, that is, the voltage of the second terminal of the capacitor becomes $V_{Int}-V_{th}$, when the driver transistor M0 is OFF, and the capacitor C stops discharging. As such, the voltage difference between the two terminals of the capacitor is: $V_{Data}-V_{Int}+V_{th}$.

During T3 stage, and during the first half of the time period, Scan=0, EM1=0, EM2=0.

Because Scan=0, the first switch transistor M1, the second switch transistor M2 and the third switch transistor M3 are all OFF; because EM1=0, the fourth switch transistor M4 is OFF; because EM2=0, the fifth switch transistor M5 and the sixth switch transistor M6 are both OFF.

During T3 stage, and during the second half of the time period, Scan=0, EM1=1, EM2=0.

Because Scan=0, the first switch transistor M1, the second switch transistor M2 and the third switch transistor M3 are all OFF; because EM2=0, the fifth switch transistor M5 and the sixth switch transistor M6 are both OFF; because EM1=1, the fourth switch transistor M4 is ON.

The fourth switch transistor M4 that is ON provides the voltage of the first power supply terminal VDD, $V_{dd}$, to the second node B, therefore the voltage of the second node B, that is, the voltage of the second terminal of the capacitor is $V_{dd}$.

The third switch transistor M3 that is OFF disconnects the data signal terminal Data with the first node A, therefore the first node A is in a floating state.

Because the first node A is in a floating state, according to the capacitor coupling principle, in order to maintain the voltage difference between the two terminals of the capacitor as: $V_{Data}-V_{Int}+V_{th}$, the voltage of the first terminal of the capacitor C has a sudden change from $V_{Data}$ to $V_{Data}+V_{dd}V_{Int}+V_{th}$.

During T4 stage, Scan=0, EM1=1, EM2=1.

Because Scan=0, the first switch transistor M1, the second switch transistor M2 and the third switch transistor M3 are all OFF; because EM2=1, the fifth switch transistor M5 and the sixth switch transistor M6 are both ON; because EM1=1, the fourth switch transistor M4 is ON.

The fifth switch transistor that is ON provides the voltage of the first node A, that is, the voltage $V_{Data}+V_{dd}-V_{Int}+V_{th}$ of the first terminal of the capacitor to the second node B, therefore the voltage of the gate electrode G of the driver transistor M0 is $V_{Data}+V_{dd}-V_{Int}+V_{th}$.

The fourth switch transistor M4 that is ON provides the voltage of the first power supply terminal VDD, $V_{dd}$, to the second node B, therefore the voltage of the source electrode S of the driver transistor M0 is $V_{dd}$.

Because the driver transistor M0 is in a saturated state, it can be known based on the characteristic of currents in a saturated state, the working current $I_L$ flowing through the driver transistor satisfies:

$$I_L=K(V_{GS}-V_{th})^2=K[(V_{Data}+V_{dd}-V_{Int}+V_{th}V_{dd})-V_{th}]^2=K(V_{Data}-V_{Int})^2$$

Wherein, $V_{GS}$ is the gate-source voltage of the driver transistor M0; K is structure parameter. Because the value of K is relatively stable in same structures, it can be treated as a constant.

It can be known from the aforementioned formula that, when the driver transistor M0 is in a saturated state, the current is only related to the voltage of the initial signal terminal Int, $V_{Int}$, and the voltage of the data signal terminal Data, $V_{Data}$, but not related to the threshold voltage $V_{th}$ of the driver transistor M0 and the voltage of the first power supply terminal VDD, $V_{dd}$.

As such, the problem associated with drifting of the threshold voltage $V_{th}$ that is caused by the manufacturing process and/or long-time operation of the driver transistor M0, as well as the influence of IR Drop on the current flowing through the light-emitting component, can be effectively solved. Therefore, the working current of the light-emitting component L can be kept stable, ensuring the normal functioning of the light-emitting component L.

In both Embodiment 1 and Embodiment 2 as described above, because there is a stable current flowing through the driver transistor at T1 stage, the hysteresis effect can be effectively avoided, which in turn can improve the response time of the driver transistor and can reduce the dark-state luminance.

Based on similar inventive concepts, in another aspect of the present disclosure, a method for driving any embodiment of the aforementioned pixel circuits as described above, is further provided.

Figure 4:
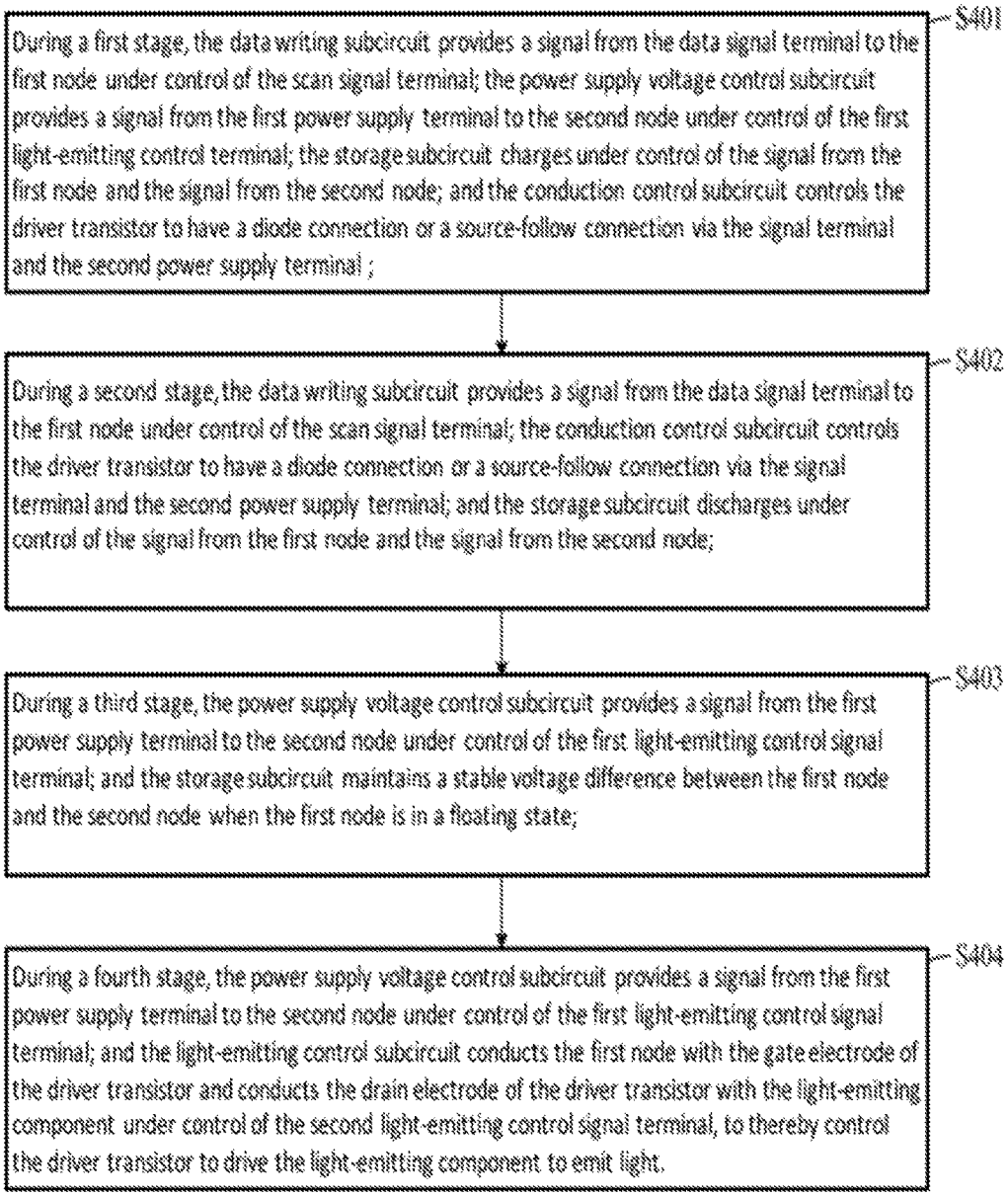
FIG. 4 is a flowchart illustrating a driving method of a pixel circuit according to some embodiments.

As shown in FIG. 4, the method comprises a first stage, a second stage, a third stage, and a fourth stage.

S401: During the first stage, the data writing subcircuit provides a signal from the data signal terminal to the first node under control of the scan signal terminal; the power supply voltage control subcircuit provides a signal from the first power supply terminal to the second node under control of the first light-emitting control terminal; the storage subcircuit charges under control of the signal from the first node and the signal from the second node; and the conduction control subcircuit controls the driver transistor to have a diode connection or a source-follow connection via the signal terminal and the second power supply terminal;

S402: During the second stage, the data writing subcircuit provides a signal from the data signal terminal to the first node under control of the scan signal terminal; the conduction control subcircuit controls the driver transistor to have a diode connection or a source-follow connection via the signal terminal and the second power supply terminal; and the storage subcircuit discharges under control of the signal from the first node and the signal from the second node;

S403: During the third stage, the power supply voltage control subcircuit provides a signal from the first power supply terminal to the second node under control of the first light-emitting control signal terminal; and the storage subcircuit maintains a stable voltage difference between the first node and the second node when the first node is in a floating state;

S404: During the fourth stage, the power supply voltage control subcircuit provides a signal from the first power supply terminal to the second node under control of the first light-emitting control signal terminal; and the light-emitting control subcircuit conducts the first node with the gate electrode of the driver transistor and conducts the drain electrode of the driver transistor with the light-emitting component under control of the second light-emitting control signal terminal, to thereby control the driver transistor to drive the light-emitting component to emit light.

According to some embodiments, the signal terminal is an initial signal terminal configured to provide a signal having a voltage lower than the voltage of the second power supply terminal.

As such, the third subcircuit controls the driver transistor to have a source-follow connection via the signal terminal and the second power supply terminal, and a working current flowing through the driver transistor satisfies:

$$I_L=K(V_{GS}-V_{th})^2=K[(V_{Data}+V_{dd}-V_{Int}+V_{th}-V_{dd})-]^2=K(V_{Data}-V_{Int})^2$$

where $I_L$ represents the working current flowing through the driver transistor; $V_{GS}$ represents the gate-source voltage of the driver transistor; K is a structure parameter; $V_{Int}$ represents the voltage of the initial signal terminal Int; $V_{Data}$ represents the voltage of the data signal terminal Data; $V_{th}$ represents the threshold voltage of the driver transistor; and $V_{dd}$ represents the voltage of the first power supply terminal.

According to some other embodiments, the signal terminal is the second power supply terminal.

As such, the third subcircuit controls the driver transistor to have a diode connection, and a working current flowing through the driver transistor satisfies:

$$I_L=K(V_{GS}-V_{th})^2=K[(V_{Data}+V_{DD}-V_{EE}+V_{th}-V_{DD})-V_{th}]^2=K(V_{Data}-V_{EE})^2$$

where $I_L$ represents the working current flowing through the driver transistor; $V_{GS}$ represents the gate-source voltage of the driver transistor; K is a structure parameter; $V_{EE}$ represents the voltage of the second power supply terminal; $V_{Data}$ represents the voltage of the data signal terminal Data; $V_{th}$ represents the threshold voltage of the driver transistor; and $V_{dd}$ represents the voltage of the first power supply terminal.

The aforementioned driving method according to some embodiments of the present disclosure can ensure that the working current of the driver transistor in the pixel circuit that drives the light-emitting component to emit light is only related to the voltage of the data signal terminal and the voltage of the initial signal terminal, but not related to the threshold voltage of the driver transistor and the voltage of the first power supply terminal.

As such, the influence of the threshold voltage of the driver transistor and IR Drop on the working current flowing through the light-emitting component can be effectively avoided. Therefore, the working current that drives the light-emitting component to emit light can be maintained stable, in turn improving the uniformity of the brightness of the images in the display area in the display apparatus.

Based on similar inventive concepts, the present disclosure further provides an organic electroluminescent display panel, which comprises a pixel circuit according to any one of the embodiments as described above. The manners in which the organic electroluminescent display panel addresses the problems are similar to that of the aforementioned pixel circuit, and the implementations of the organic electroluminescent display panel can reference to the implementations of the aforementioned pixel circuits. It will not be repeated herein.

Based on similar inventive concepts, the present disclosure further provides a display apparatus, which comprises the organic electroluminescent display panel according to any of the embodiments as described above.

Herein the display apparatus can be any products or components that have display functions such as cell phones, tablets, television, monitors, notebooks, digital photo frames and navigators. Other essential components for the display apparatus can be understood by those skilled in the art, and thus they will not be repeated herein and they shall not be construed as limitations to the scope of the present disclosure. The implementations of the display apparatus can reference to the embodiments of the pixel circuit, and they will not be repeated herein.

All references cited in the present disclosure are incorporated by reference in their entirety. Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. An electronic circuit configured to maintain a substantially stable working current running through an electronic component, comprising:

a drive subcircuit, comprising a first terminal, a second terminal, and a third terminal, wherein the first terminal is coupled to a second node; a current from a first terminal to a second terminal is controlled by a signal from a third terminal, and the drive subcircuit is configured to drive the electronic component via the second terminal;

a first subcircuit, coupled to a data signal terminal, a scan signal terminal and a first node, and configured to provide a signal from the data signal terminal to the first node under control of the scan signal terminal;

a second subcircuit, coupled to a first power supply terminal, a first control signal terminal and a second node, and configured to provide a signal from the first power supply terminal to the second node under control of the first control signal terminal;

a third subcircuit, coupled to the scan signal terminal and a second power supply terminal and to the second terminal and the third terminal of the drive subcircuit, and configured to control the drive subcircuit to have a diode connection or a source-follow connection via the scan signal terminal and the second power supply terminal;

a fourth subcircuit, coupled to the first node and the second node, and configured to charge or discharge under control of a signal from the first node and a signal from the second node, and to maintain a stable voltage difference between the first node and the second node if the first node is in a floating state; and a fifth subcircuit, coupled to a second control signal terminal, the first node, the second terminal, and the third terminal, of the drive subcircuit, and a first terminal of the electronic component, and configured to electrically couple the first node with the third terminal of the drive subcircuit, and to electrically couple the second terminal of the drive subcircuit with the electronic component under control of the second control signal terminal, so as to control the drive subcircuit to drive the electronic component;

wherein:

the drive subcircuit comprises a driver transistor, wherein the first terminal, the second terminal, and the third terminal thereof are respectively a source electrode, a drain electrode, and a gate electrode of the driver transistor; and the third subcircuit comprises:

a first sub-portion, wherein:

a first terminal of the first sub-portion is coupled to the scan signal terminal;

a second terminal of the first sub-portion is coupled to a signal terminal;

a third terminal of the first sub-portion is coupled to the gate electrode of the driver transistor; and the first sub-portion is configured to provide a signal from the signal terminal to the gate electrode of the driver transistor under control of the scan signal terminal, wherein the signal has a voltage lower than or equal to a voltage of the second power supply terminal;

and a second sub-portion, wherein:

a first terminal of the second sub-portion is coupled to the scan signal terminal;

a second terminal of the second sub-portion is coupled to the second power supply terminal;

a third terminal of the second sub-portion is coupled to the drain electrode of the driver transistor; and the second sub-portion is configured to provide a signal from the second power supply terminal to the drain electrode of the driver transistor under control of the scan signal terminal.

2. The electronic circuit of claim 1, wherein the first sub-portion comprises a first switch transistor, wherein:

a gate electrode of the first switch transistor is coupled to the scan signal terminal;

a source electrode of the first switch transistor is coupled to the signal terminal; and a drain electrode of the first switch transistor is coupled to the gate electrode of the driver transistor.

3. The electronic circuit of claim 2, wherein the second sub-portion comprises a second switch transistor, wherein:

a gate electrode of the second switch transistor is coupled to the scan signal terminal;

a source electrode of the second switch transistor is coupled to the second power supply terminal; and a drain electrode of the second switch transistor is coupled to the drain electrode of the driver transistor.

4. The electronic circuit of claim 2, wherein the signal terminal is the second power supply terminal.

5. The electronic circuit of claim 2, wherein the signal terminal is an initial signal terminal, configured to provide a signal having a voltage lower than the voltage of the second power supply terminal.

6. The electronic circuit of claim 1, wherein at least one of the first subcircuit, the second subcircuit, or the fifth subcircuit comprises a switch transistor.

7. The electronic circuit of claim 6, wherein the first subcircuit comprises a third switch transistor, wherein:

a gate electrode of the third switch transistor is coupled to the scan signal terminal;

a source electrode of the third switch transistor is coupled to the data signal terminal; and a drain electrode of the third switch transistor is coupled to the first node.

8. The electronic circuit of claim 6, wherein the second subcircuit comprises a fourth switch transistor, wherein:

a gate electrode of the fourth switch transistor is coupled to the first control signal terminal;

a source electrode of the fourth switch transistor is coupled to the first power supply terminal; and a drain electrode of the fourth switch transistor is coupled to the second node.

9. The electronic circuit of claim 1, wherein the fourth subcircuit comprises a capacitor, wherein:

a first terminal of the capacitor is coupled to the first node; and a second terminal of the capacitor is coupled to the second node.

10. The electronic circuit of claim 1, wherein the driver transistor is a P-type transistor.

11. The electronic circuit of claim 1, wherein the electronic component comprises a light-emitting component.

12. The electronic circuit of claim 11, wherein the light-emitting component comprises an organic light-emitting diode (OLED), and the electronic circuit is configured to maintain the substantially stable working current through the driver transistor independent of a threshold voltage of the driver transistor or a power supply voltage of the first power supply terminal.

13. A display panel, comprising an electronic circuit according to claim 1.

14. An electronic circuit configured to maintain a substantially stable working current running through an electronic component, comprising:

a drive subcircuit, comprising a first terminal, a second terminal, and a third terminal, wherein the first terminal is coupled to a second node; a current from a first terminal to a second terminal is controlled by a signal from a third terminal, and the drive subcircuit is configured to drive the electronic component via the second terminal;

a first subcircuit, coupled to a data signal terminal, a scan signal terminal and a first node, and configured to provide a signal from the data signal terminal to the first node under control of the scan signal terminal;

a second subcircuit, coupled to a first power supply terminal, a first control signal terminal and a second node, and configured to provide a signal from the first power supply terminal to the second node under control of the first control signal terminal;

a third subcircuit, coupled to the scan signal terminal and a second power supply terminal and to the second terminal and the third terminal of the drive subcircuit, and configured to control the drive subcircuit to have a diode connection or a source-follow connection via the scan signal terminal and the second power supply terminal;

a fourth subcircuit, coupled to the first node and the second node, and configured to charge or discharge under control of a signal from the first node and a signal from the second node, and to maintain a stable voltage difference between the first node and the second node if the first node is in a floating state; and a fifth subcircuit, coupled to a second control signal terminal, the first node, the second terminal, and the third terminal, of the drive subcircuit, and a first terminal of the electronic component, and configured to electrically couple the first node with the third terminal of the drive subcircuit, and to electrically couple the second terminal of the drive subcircuit with the electronic component under control of the second control signal terminal, so as to control the drive subcircuit to drive the electronic component;

wherein at least one of the first subcircuit, the second subcircuit, or the fifth subcircuit comprises a switch transistor; and wherein the fifth subcircuit comprises:

a fifth switch transistor, wherein:

a gate electrode of the fifth switch transistor is coupled to the second control signal terminal;

a source electrode of the fifth switch transistor is coupled to the first node;

a drain electrode of the fifth switch transistor is coupled to the gate electrode of the driver transistor;

and a sixth switch transistor, wherein:

a gate electrode of the sixth switch transistor is coupled to the second control signal terminal;

a source electrode of the sixth switch transistor is coupled to the drain electrode of the driver transistor; and a drain electrode of the sixth switch transistor is coupled to the first terminal of the electronic component.

15. A method of driving an electronic circuit configured to maintain a substantially stable working current running through an electronic component, the electronic circuit comprising:

a drive subcircuit, comprising a first terminal, a second terminal, and a third terminal, wherein the first terminal is coupled to a second node; a current from a first terminal to a second terminal is controlled by a signal from a third terminal, and the drive subcircuit is configured to drive the electronic component via the second terminal;

a first subcircuit, coupled to a data signal terminal, a scan signal terminal and a first node, and configured to provide a signal from the data signal terminal to the first node under control of the scan signal terminal;

a second subcircuit, coupled to a first power supply terminal, a first control signal terminal and a second node, and configured to provide a signal from the first power supply terminal to the second node under control of the first control signal terminal;

a third subcircuit, coupled to the scan signal terminal and a second power supply terminal and to the second terminal and the third terminal of the drive subcircuit, and configured to control the drive subcircuit to have a diode connection or a source-follow connection via the scan signal terminal and the second power supply terminal;

a fourth subcircuit, coupled to the first node and the second node, and configured to charge or discharge under control of a signal from the first node and a signal from the second node, and to maintain a stable voltage difference between the first node and the second node if the first node is in a floating state; and a fifth subcircuit, coupled to a second control signal terminal, the first node, the second terminal, and the third terminal, of the drive subcircuit, and a first terminal of the electronic component, and configured to electrically couple the first node with the third terminal of the drive subcircuit, and to electrically couple the second terminal of the drive subcircuit with the electronic component under control of the second control signal terminal, so as to control the drive subcircuit to drive the electronic component;

wherein:

the drive subcircuit comprises a driver transistor, wherein the first terminal, the second terminal, and the third terminal thereof are respectively a source electrode, a drain electrode, and a gate electrode of the driver transistor, the method comprising:

a first stage, wherein:

the first subcircuit provides a signal from the data signal terminal to the first node under control of the scan signal terminal;

the second subcircuit provides a signal from the first power supply terminal to the second node under control of the first control terminal;

the fourth subcircuit charges under control of the signal from the first node and the signal from the second node; and the third subcircuit controls the driver transistor to have a diode connection or a source-follow connection via the signal terminal and the second power supply terminal;

a second stage, wherein:

the first subcircuit provides a signal from the data signal terminal to the first node under control of the scan signal terminal;

the third subcircuit controls the driver transistor to have a diode connection or a source-follow connection via the signal terminal and the second power supply terminal; and the fourth subcircuit discharges under control of the signal from the first node and the signal from the second node;

a third stage, wherein:

the second subcircuit provides a signal from the first power supply terminal to the second node under control of the first control signal terminal; and the fourth subcircuit maintains a stable voltage difference between the first node and the second node when the first node is in a floating state;

and a fourth stage, wherein:

the second subcircuit provides a signal from the first power supply terminal to the second node under control of the first control signal terminal; and the fifth subcircuit conducts the first node with the gate electrode of the driver transistor and conducts the drain electrode of the driver transistor with the electronic component under control of the second control signal terminal, to thereby control the driver transistor to drive the electronic component.

16. The method of claim 15, wherein during a saturation mode of the driver transistor, the working current flowing through the driver transistor is independent of a threshold voltage of the driver transistor or a power supply voltage of the first power supply terminal.

17. The method of claim 16, wherein the signal terminal is an initial signal terminal configured to provide a signal having a voltage lower than the voltage of the second power supply terminal, and the third subcircuit controls the driver transistor to have a source-follow connection via the signal terminal and the second power supply terminal, wherein:

the working current flowing through the driver transistor satisfies:

$$I_L=K(V_{GS}-V_{th})^2=K[(V_{Data}+V_{DD}-V_{Int}+V_{th}-V_{DD})-V_{th}]^2=K(V_{Data}-V_{Int})^2$$

wherein $I_L$ represents the working current flowing through the driver transistor; $V_{GS}$ represents the gate-source voltage of the driver transistor; K is a structure parameter; $V_{int}$ represents the voltage of the initial signal terminal Int; $V_{Data}$ represents the voltage of the data signal terminal Data; $V_{th}$ represents the threshold voltage of the driver transistor; and $V_{dd}$ represents the voltage of the first power supply terminal.

18. The method of claim 16, wherein the signal terminal is the second power supply terminal, and the third subcircuit controls the driver transistor to have a diode connection, wherein:

the working current flowing through the driver transistor satisfies:

$$I_L=K(V_{GS}-V_{th})^2=K[(V_{Data}+V_{DD}-V_{EE}+V_{th}-V_{DD})-V_{th}]^2=K(V_{Data}-V_{EE})^2$$

wherein $I_L$ represents the working current flowing through the driver transistor; $V_{GS}$ represents the gate-source voltage of the driver transistor; K is a structure parameter; $V_{EE}$ represents the voltage of the second power supply terminal; $V_{Data}$ represents the voltage of the data signal terminal Data; $V_{th}$ represents the threshold voltage of the driver transistor; and $V_{dd}$ represents the voltage of the first power supply terminal.

* * * * *